US010400976B2

(12) United States Patent
Kuwata et al.

(10) Patent No.: US 10,400,976 B2
(45) Date of Patent: Sep. 3, 2019

(54) LIGHT SOURCE FOR HEADLIGHT AND HEADLIGHT FOR MOVING OBJECT

(71) Applicant: MITSUBISHI ELECTRIC CORPORATION, Tokyo (JP)

(72) Inventors: Muneharu Kuwata, Tokyo (JP); Takashi Ohsawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 93 days.

(21) Appl. No.: 15/744,660

(22) PCT Filed: Oct. 13, 2015

(86) PCT No.: PCT/JP2015/078905
§ 371 (c)(1),
(2) Date: Jan. 12, 2018

(87) PCT Pub. No.: WO2017/064753
PCT Pub. Date: Apr. 20, 2017

(65) Prior Publication Data

US 2019/0003675 A1 Jan. 3, 2019

(51) Int. Cl.
*F21S 41/147* (2018.01)
*F21S 41/32* (2018.01)
(Continued)

(52) U.S. Cl.
CPC ..... *F21S 41/322* (2018.01); *F21S 41/00* (2018.01); *F21S 41/147* (2018.01);
(Continued)

(58) Field of Classification Search
CPC ..... F21S 41/147; F21S 41/148; F21S 41/25; F21S 41/27; F21S 41/43; F21S 41/332
See application file for complete search history.

(56) References Cited

U.S. PATENT DOCUMENTS 7,097,334 B2 * 8/2006 Ishida ..... F21S 41/147 362/516
7,182,497 B2 * 2/2007 Lee ..... F21V 7/0091 348/E9.027

(Continued)

FOREIGN PATENT DOCUMENTS

JP 01-130203 U1 9/1989
JP 10-200168 A 7/1998

(Continued)

*Primary Examiner* — Julie A Bannan
(74) *Attorney, Agent, or Firm* — Birch, Stewart, Kolasch & Birch, LLP

(57) ABSTRACT

In a light source for headlight, the light emitting element is arranged to be displaced from an optical axis of the projection lens part. The reflection surface part is in a shape of a concave mirror having an optical axis and one focal point on the optical axis. An optical center which is an intersection of the reflection surface part and the optical axis of the reflection surface part is arranged on the optical axis of the projection lens part and between the projection lens part and a focal point of the projection lens part. The optical axis of the reflection surface part is oriented in a direction passing a position between a central part of a light emitting surface of the light emitting element and a central part of the projection lens part.

15 Claims, 23 Drawing Sheets

(51) Int. Cl.

| | |
|---|---|
| ***F21S 41/00*** | (2018.01) |
| ***F21S 43/00*** | (2018.01) |
| ***F21S 41/155*** | (2018.01) |
| ***F21S 41/27*** | (2018.01) |
| ***F21S 41/43*** | (2018.01) |
| ***F21S 41/25*** | (2018.01) |
| ***F21S 41/148*** | (2018.01) |
| ***F21S 41/663*** | (2018.01) |

(52) U.S. Cl.
CPC ..... *F21S 41/148* (2018.01); *F21S 41/155* (2018.01); *F21S 41/25* (2018.01); *F21S 41/27* (2018.01); *F21S 41/43* (2018.01); *F21S 41/663* (2018.01); *F21S 43/00* (2018.01)

(56) References Cited

U.S. PATENT DOCUMENTS

| | | | | |
|---|---|---|---|---|
| 2004/0042212 | A1 | 3/2004 | Du et al. | |
| 2011/0085333 | A1 | 4/2011 | Ohno et al. | |
| 2013/0063960 | A1 | 3/2013 | Nakano et al. | |
| 2016/0178155 | A1* | 6/2016 | Owada ..... | B60Q 1/08 |
| 2018/0363878 | A1* | 12/2018 | Potluri ..... | F21S 43/33 |
| 2019/0063716 | A1* | 2/2019 | Bushre ..... | F21S 41/36 |

FOREIGN PATENT DOCUMENTS

| | | | |
|---|---|---|---|
| JP | 2005-537665 | A | 12/2005 |
| JP | 2010-108639 | A | 5/2010 |
| JP | 2011-082067 | A | 4/2011 |
| JP | 2012-084330 | A | 4/2012 |
| JP | 2013-062068 | A | 4/2013 |
| JP | 2015-079614 | A | 4/2015 |

* cited by examiner

LIGHT SOURCE FOR HEADLIGHT AND HEADLIGHT FOR MOVING OBJECT

TECHNICAL FIELD

The present invention relates to a headlight for moving object, and particularly, relates to a light source for the headlight.

BACKGROUND ART

Conventionally, as a light source for vehicle-mounted headlight, an electric lamp employing a tungsten filament as a light emitting body, an electric-discharge lamp emitting light through arc discharge, or the like is used.

Further, recently, in place of electric lamps and electric-discharge lamps, light emitting diodes (LEDs) have become widespread. Because LEDs have a long life, can ensure brightness needed for headlights with low power consumption, and can stabilize brightness under a simple control operation of supplying a constant current thereto, LEDs are suitable for use as light sources for vehicle-mounted headlight. Further, LEDs have many variations in size and brightness, so that the number of light sources used to form a light distribution of a headlight, and the shape of each of the light sources can be selected freely. Therefore, a headlight with high originality or a reduced size headlight which, conventionally, was not able to be implemented because of restrictions on the number of light sources or their shapes can be implemented.

In each of Patent Literatures 1 to 3, a headlight having alight source, a reflector for reflecting light emitted by the light source, and a projection lens for projecting the light reflected by the reflector onto an area ahead of a vehicle is disclosed. In particular, in each of Patent Literatures 2 and 3, a headlight in which an LED is used as a light source, and a reflector and a projection lens being integrally formed of a transparent material is also disclosed.

CITATION LIST

Patent Literature

Patent Literature 1: Japanese Unexamined Utility Model (Registration) Application Publication No. Hei 1-130203 (1989-130203)

Patent Literature 2: Japanese Unexamined Patent Application Publication No. 2010-108639

Patent Literature 3: Japanese Unexamined Patent Application Publication No. 2012-84330

SUMMARY OF INVENTION

Technical Problem

In recent years, there is a demand for further downsizing vehicle-mounted headlights, and a demand for further downsizing light sources for vehicle-mounted headlights. As a method of implementing downsizing of light sources, a method of shortening the focal length of a projection lens can be considered. However, generally, a convex lens with a short focal length has a large curvature, and it is therefore difficult to form such a convex lens. Further, various kinds of aberration tend to become large, and it is therefore difficult to produce a lens having desired optical characteristics. Therefore, it is difficult to form a projection lens by using a single convex lens while shortening the focal length.

To cope with this problem, a configuration in which an auxiliary convex lens opposite to a projection lens is disposed, thereby shortening the focal length with a combination of two convex lenses can be considered. However, in this configuration, the number of parts increases due to the auxiliary convex lens, and this results in increase in the cost.

The reflector and the projection lens which are described in Patent Literatures 1 to 3 do not fully utilize their optical characteristics in order to downsize the light source.

The present invention is made for solving the above-mentioned problems, and it is therefore an object of the present invention to provide a light source for headlight that can shorten its focal length without increasing the number of parts. Another object of the present invention is to provide a headlight for a moving object which employs such a light source for headlight.

Solution To Problem

A light source for headlight according to the present invention includes: a light emitting element; and a light guide member having a reflection surface part reflecting light emitted by the light emitting element, and a projection lens part projecting the light reflected by the reflection surface part onto an area ahead of a moving object. The light emitting element is arranged to be displaced from an optical axis of the projection lens part. The reflection surface part is in a shape of a concave mirror having an optical axis and one focal point on the optical axis. An optical center which is an intersection of the reflection surface part and the optical axis of the reflection surface part is arranged on the optical axis of the projection lens part and between the projection lens part and a focal point of the projection lens part. The optical axis of the reflection surface part is oriented in a direction passing a position between a central part of a light emitting surface of the light emitting element and a central part of the projection lens part.

A headlight for a moving object according to the present invention includes the light source for headlight described above.

Advantageous Effects Of Invention

According to the light source for headlight of the present invention, the focal length can be shorten, without increasing the number of parts in comparison with a configuration in which an auxiliary convex lens is disposed. Further, according to the present invention, a headlight for moving object which employs this light source for headlight can be provided.

DESCRIPTION OF EMBODIMENTS

Hereafter, in order to explain the present invention in more detail, some embodiments of the present invention will be described with reference to the accompanying drawings.

Embodiment 1

Figure 1:
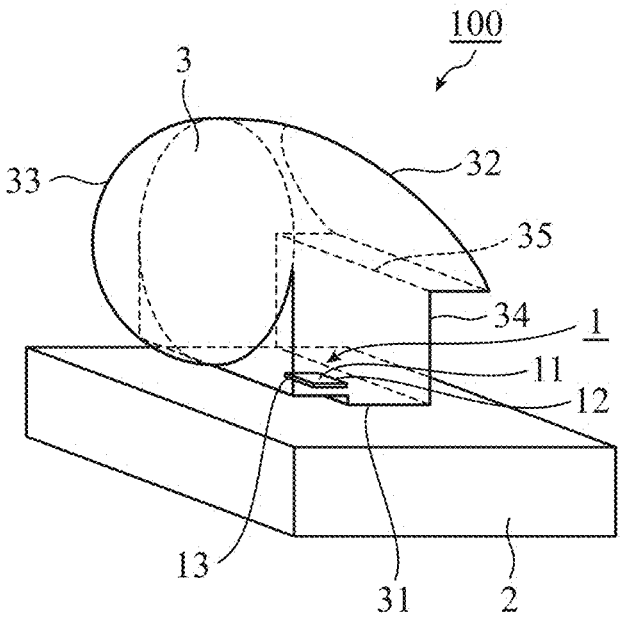
FIG. 1 is a perspective view of a light source for headlight according to Embodiment 1 of the present invention.
Figure 2B:
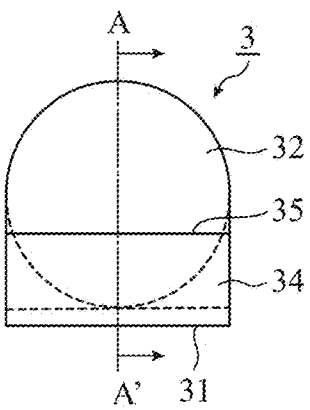
FIG. 2B is a rear view of the light guide member shown in FIG. 1.
Figure 2A:
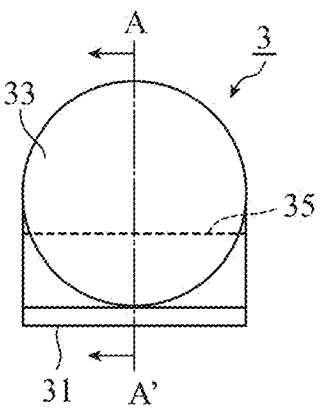
FIG. 2A is a front view of a light guide member shown in FIG. 1.
Figure 2D:
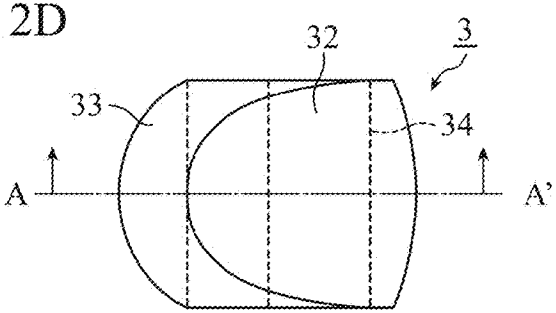
FIG. 2D is a plan view of the light guide member shown in FIG. 1.
Figure 2C:
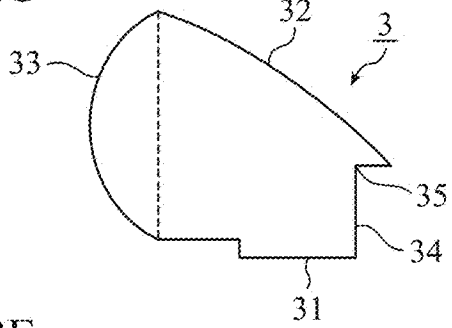
FIG. 2C is a side view of the light guide member shown in FIG. 1.
Figure 2E:
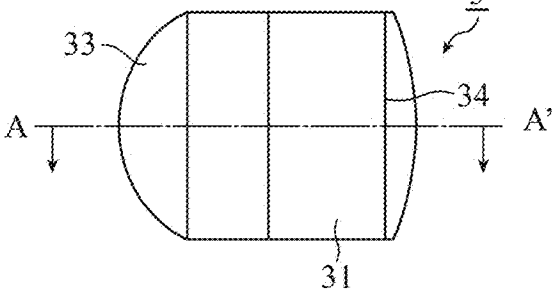
FIG. 2E is a bottom view of the light guide member shown in FIG. 1.

FIG. 1 is a perspective view of a light source for headlight 100. FIG. 2A is a front view of a light guide member 3 shown in FIG. 1. FIG. 2B is a rear view of the light guide member 3 shown in FIG. 1. FIG. 2C is a side view of the light guide member 3 shown in FIG. 1. FIG. 2D is a plan view of the light guide member 3 shown in FIG. 1. FIG. 2E is a bottom view of the light guide member 3 shown in FIG. 1. The light source for headlight 100 according to Embodiment 1 which is configured as, for example, a vehicle-mounted light source will be explained with reference to FIG. 1 and FIGS. 2A to 2E.

The light emitting element 1 is, for example, a semiconductor light emitting element, such as a light emitting diode (LED), an organic light emitting diode (OLED), or a laser diode (LD). The light emitting element 1 emits light from a light emitting surface 11 when an electric current is supplied.

The light emitting element 1 is fixed to a fixing member 2. The fixing member 2 is, for example, a circuit board for semiconductor light emitting element, and functions as a heat radiating member for dissipating heat generated by the light emitting element 1.

The light guide member 3 is arranged opposite to the light emitting surface 11 of the light emitting element 1. The light guide member 3 is integrally formed of, for example, a transparent resin, such as acrylics or polycarbonate, or glass. The light guide member 3 has an incidence surface part 31 to which light emitted by the light emitting element 1 is incident, a reflection surface part 32 that reflects the light incident from the incidence surface part 31, and a projection lens part 33 that focuses the light reflected by the reflection surface part 32 and projects the light onto an area ahead of a vehicle.

Further, in the light guide member 3, a reflection surface part for light distribution formation 34 is formed between the incidence surface part 31 and the reflection surface part 32. The reflection surface part for light distribution formation 34 reflects apart of the light incident to the incidence surface part 31, thereby forming a light distribution used in a case when the light source is used for a low-beam light of a vehicle-mounted headlight.

Figure 3:
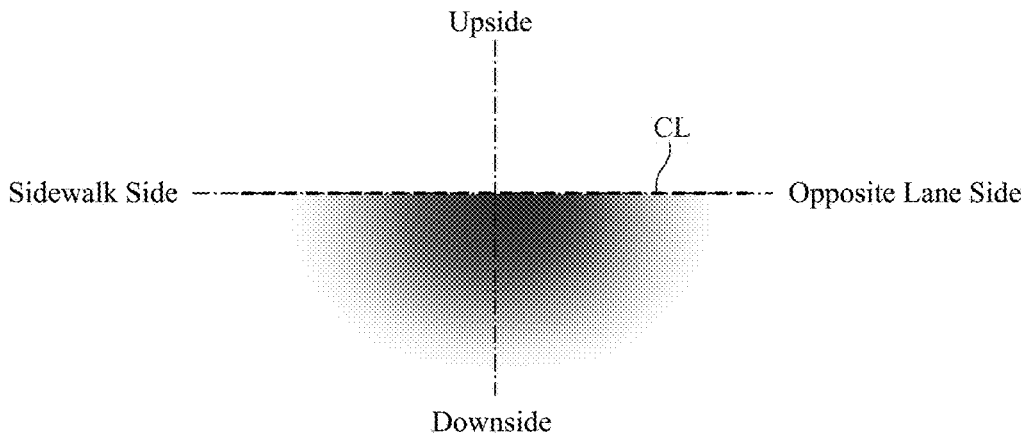
FIG. 3 is an explanatory drawing showing an example of a light distribution of a low-beam light.

An example of the low-beam light distribution of the vehicle-mounted headlight is shown in FIG. 3. The reflection surface part for light distribution formation 34 reflects apart of the light incident to the incidence surface part 31 which goes toward the rear side of the vehicle, so that the light distribution of the light source for headlight 100 illuminating only an area below a cutoff line CL, as shown in FIG. 3, is realized. The cutoff line CL corresponds to an edge 35 of the reflection surface part for light distribution formation 34, the edge 35 being on a side of the reflection surface part 32, and the light distribution in the vicinity of the cutoff line CL is determined dependently on the shape of the edge 35.

The light emitting element 1, the fixing member 2, and the light guide member 3 compose the light source for headlight 100. Namely, the light source for headlight 100 shown in FIG. 1 and FIGS. 2A to 2E is a light source for low-beam light.

Next, a detailed configuration of the light source for headlight 100 will be explained with reference to FIG. 4.

Figure 4:
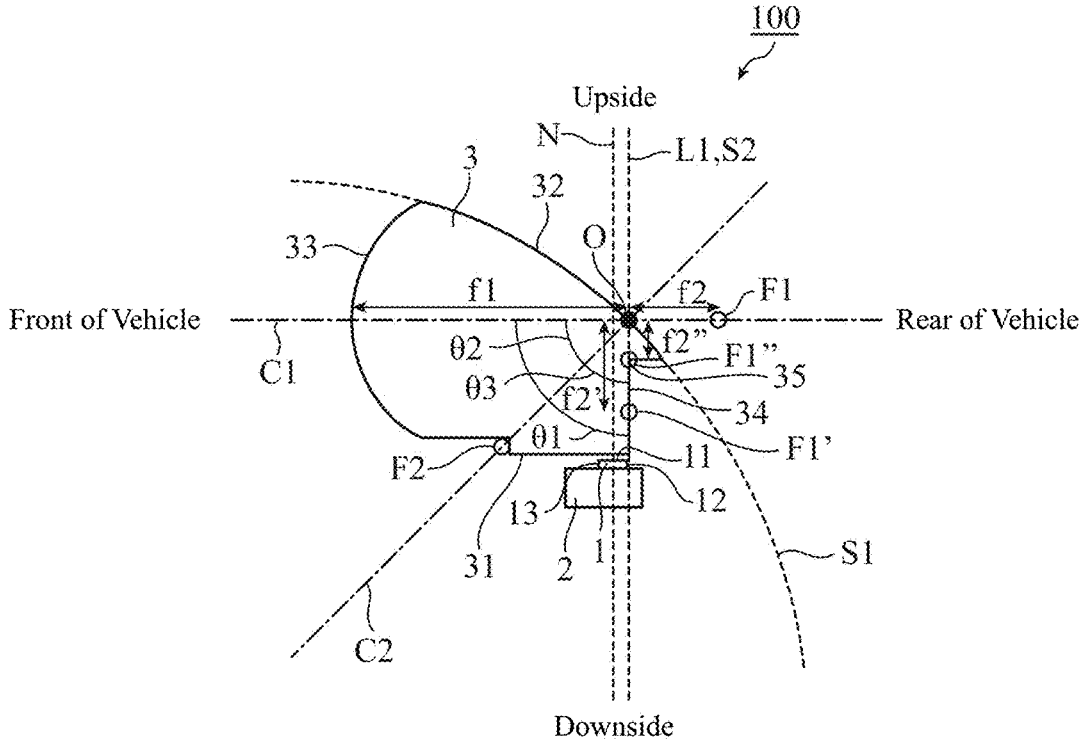
FIG. 4 is a cross-sectional view taken along the A-A' line shown in FIG. 2.

As shown in FIG. 4, the projection lens part 33 is in the shape of a convex lens, and has an optical axis C1 and also has a focal point F1 on the optical axis C1. The light emitting element 1 is arranged to be displaced from the optical axis C1 of the projection lens part 33. Concretely, the light emitting element 1 is arranged below the optical axis C1. Further, the light emitting element 1 is positioned and oriented in such a way that the normal N to the light emitting surface 11 at the central part of the light emitting surface 11 is perpendicular to the optical axis C1 of the projection lens part 33.

The reflection surface part 32 is formed in the shape of a concave mirror having an optical axis C2 and also having one focal point F2 on the optical axis C2. Concretely, the reflection surface part 32 has a shape extending along, for example, a paraboloid or a spherical surface. In the example shown in FIG. 4, the reflection surface part 32 has a shape extending along a paraboloid S1. An optical center O which is an intersection of the reflection surface part 32 and the optical axis C2 of the reflection surface part 32 is arranged on the optical axis C1 of the projection lens part 33, and is arranged between the projection lens part 33 and the focal point F1 of the projection lens part 33.

Further, the optical axis C2 of the reflection surface part 32 is oriented toward the center of an angle θ1 which the optical axis C1 of the projection lens part 33 forms with a straight line L1 passing through the optical center O of the reflection surface part 32 and the central part of the edge 35 of the reflection surface part for light distribution formation 34, the edge being on a side of the reflection surface part 32. In the example shown in FIG. 4, the optical axis C1 and the straight line L1 are perpendicular to each other, the angle θ2 which the optical axis C1 forms with the optical axis C2 is 45 degrees, and the angle θ3 which the straight line L1 forms with the optical axis C2 is 45 degrees.

Further, an edge 12 of the light emitting surface 11 of the light emitting element 1, the edge being on the rear side of the vehicle, is arranged on a surface S2 extending along the reflection surface part for light distribution formation 34. In the example of FIG. 4, because the surface S2 is in the shape of a plane, and the straight line L1 extends along this plane, L1 and S2 overlaps each other in the figure.

Next, an operation and effects of the light source for headlight 100 will be explained with reference to FIG. 4.

Because the optical axis C2 of the reflection surface part 32 is oriented toward the center of the angle θ1 which the optical axis C1 forms with the straight line L1, the reflection surface part 32 reflects the light which is emitted by the light emitting element 1 and is incident to the incidence surface part 31 toward the projection lens part 33. At this time, because the reflection surface part 32 is in the shape of a concave mirror having the focal point F2, the incident light is reflected and converged by the reflection surface part 32 to be a reflected light. Further, because the optical center O of the reflection surface part 32 is arranged between the projection lens part 33 and the focal point F1 of the projection lens part 33, the projection lens part 33 further converges the light converged by the reflection surface part 32 and projects the light onto an area ahead of the vehicle.

As described above, due to the configuration in which the projection lens part 33 in the shape of a convex lens further converges the light converged by the reflection surface part 32 in the shape of a concave mirror, the light source for headlight 100 according to Embodiment 1 can reduce the focal length to less than the focal length in a conventional light source for headlight. Further, by forming the reflection surface part 32 into the shape of a concave mirror, the focal length can be reduced to less than, for example, that in the case in which the reflection surface part is formed into the shape of a plane mirror. More specifically, in the case in which the reflection surface part is formed into the shape of a plane mirror, the focal length (f1+f2') from the projection lens part 33 to a combined focal point F1' of the projection lens part 33 and the reflection surface part has the same value as the focal length (f1+f2) from the projection lens part 33 to the focal point F1 of the sole projection lens part 33. In contrast, in the case in which the reflection surface part 32 is formed into the shape of a concave mirror, the focal length (f1+f2") from the projection lens part 33 to a combined focal point F1" of the projection lens part 33 and the reflection surface part 32 can be reduced to less than the focal length (f1+f2) from the projection lens part 33 to the focal point F1 of the sole projection lens part 33. By shortening the focal length, like in the case of a configuration in which an auxiliary convex lens opposite to the projection lens part 33 is disposed as a member separate from the light guide member 3, the light source for headlight 100 can be downsized.

Note that, in the configuration of shortening the focal length by using the combination of the projection lens part 33 and the reflection surface part 32 in the shape of a concave mirror, the above-mentioned auxiliary convex lens is not required so that the number of parts can be decreased.

Further, in the configuration of shortening the focal length by using the combination of the projection lens part 33 and the reflection surface part 32 in the shape of a concave mirror, the curvature of the projection lens part 33 can be reduced to less than that in a configuration in which a convex lens having a short focal length is used as the projection lens part 33. For this reason, the forming of the projection lens part 33 can be facilitated and the forming accuracy can be improved. Further, aberration of the projection lens part 33 can be reduced.

Further, by forming the reflection surface part 32 into the shape of a concave mirror extending along the paraboloid S1, the occurrence of chromatic aberration by the reflection surface part 32 can be prevented. By combining the projection lens part 33 having a small curvature, and the reflection surface part 32 having no chromatic aberration, the color separation occurring in the vicinity of the cutoff line CL in the low-beam light distribution can be suppressed.

Further, by arranging the edge 12 of the light emitting surface 11 of the light emitting element 1 on the surface S2, the edge being on the rear side of the vehicle, the whole surface of the light emitting surface 11 is positioned opposite to the incidence surface part 31. As a result, the light emitted by the light emitting element 1 is effectively used, and the utilization efficiency of the light can be increased.

Further, as shown in FIG. 4, the edge 35 of the reflection surface part for light distribution formation 34, the edge being on a side of the reflection surface part 32, can be arranged at the combined focal point F1" of the projection lens part 33 and the reflection surface part 32. As a result, in the low-beam light distribution, the cutoff line CL can be formed sharply.

Figure 5:
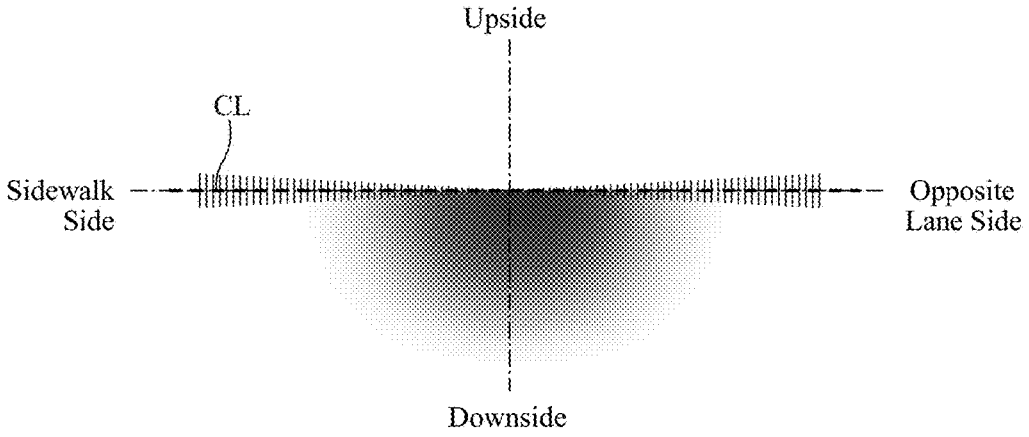
FIG. 5 is an explanatory drawing showing another example of the low-beam light distribution.
Figure 6B:
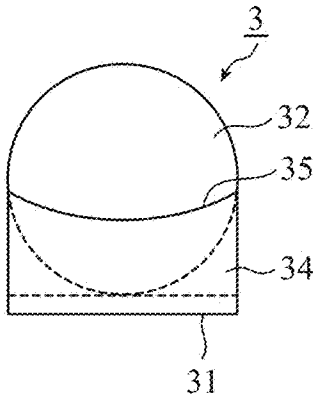
FIG. 6B is a rear view of another example of the light guide member according to Embodiment 1.
Figure 6D:
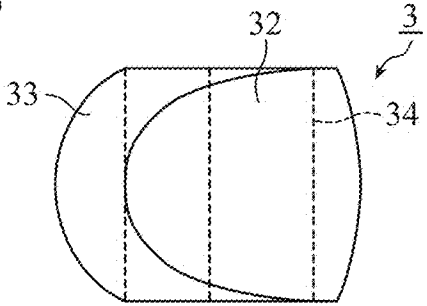
FIG. 6D is a plan view of another example of the light guide member according to Embodiment 1.
Figure 6C:
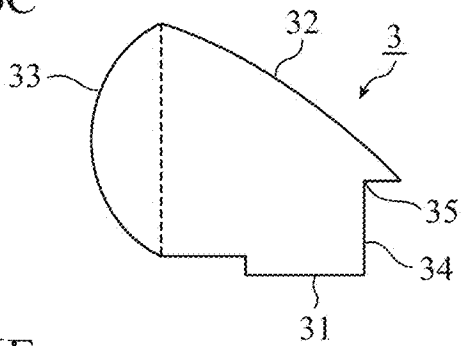
FIG. 6C is a side view of another example of the light guide member according to Embodiment 1.
Figure 6E:
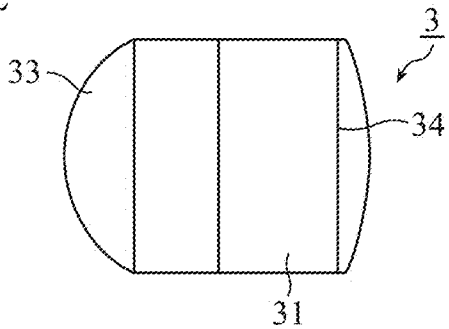
FIG. 6E is a bottom view of another example of the light guide member according to Embodiment 1.
Figure 6A:
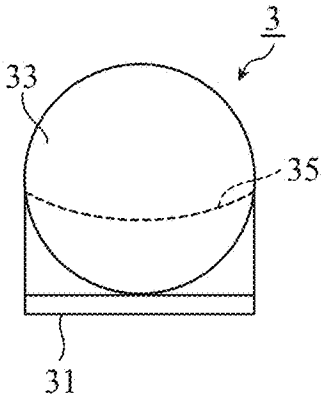
FIG. 6A is a front view of another example of the light guide member according to Embodiment 1.
Figure 7B:
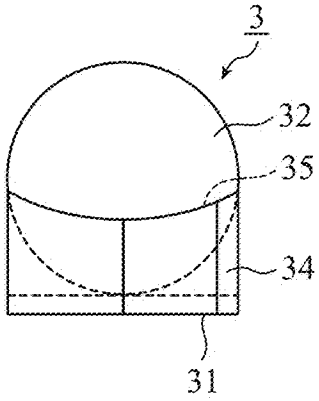
FIG. 7B is a rear view of another example of the light guide member according to Embodiment 1.
Figure 7D:
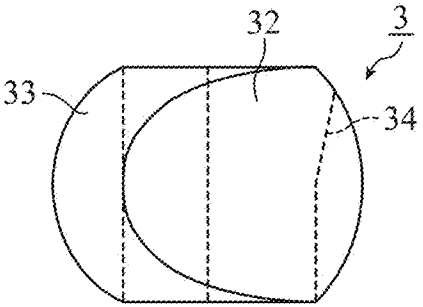
FIG. 7D is a plan view of another example of the light guide member according to Embodiment 1.
Figure 7C:
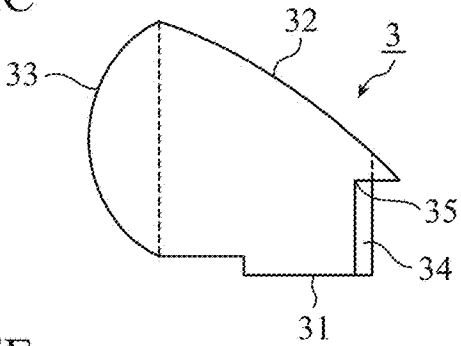
FIG. 7C is a side view of another example of the light guide member according to Embodiment 1.
Figure 7E:
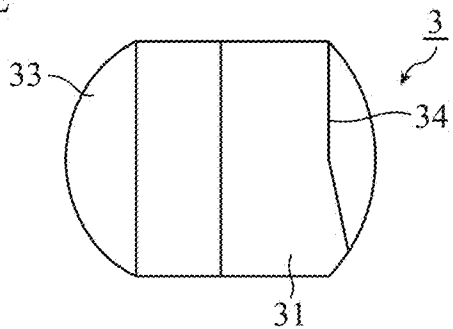
FIG. 7E is a bottom view of another example of the light guide member according to Embodiment 1.
Figure 7A:
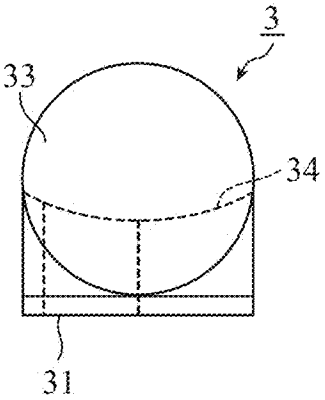
FIG. 7A is a front view of another example of the light guide member according to Embodiment 1.

In the case in which the edge 35 of the reflection surface part for light distribution formation 34 is formed into a linear shape as shown in FIG. 1 and FIGS. 2A to 2E, and the central part of the edge 35 is arranged at the combined focal point F1" as shown in FIG. 4, though the central part of the edge 35 is arranged at the combined focal point F1", the nearer the both ends of the edge 35 is, the farther the edge 35 is apart from the combined focal point F1", dependently on the curvature of the projection lens part 33. For this reason, as shown in FIG. 5, the central part of the cutoff line CL is sharp in the low-beam light distribution while the cutoff line may gradually become blurred toward the side closer to the both ends.

To solve this problem, as shown in FIG. 6, the edge 35 of the reflection surface part for light distribution formation 34 may be formed into a curved shape in such a way that both ends thereof are closer to the optical axis C1 of the projection lens part 33 than the center thereof. Namely, in a case in which a field curvature occurs due to the combination of the reflection surface part 32 in the shape of a concave mirror and the projection lens part 33 in the shape of a convex lens, the edge 35 is formed to be curved to correct the field curvature. As a result, the whole edge 35 of the reflection surface part for light distribution formation 34 is arranged at the combined focal point F1" of the projection lens part 33 and the reflection surface part 32 so that the whole cutoff line CL can be made sharper.

The shape of the edge 35 of the reflection surface part for light distribution formation 34 is not limited to any of the ones shown in FIGS. 2A to 2E, FIGS. 3 to 5, and FIGS. 6A to 6E, and the edge 35 can be formed into any shape dependently on a light distribution which is required for the light source for headlight 100. Hereafter, with reference to FIGS. 7A to 7E, FIG. 8, FIGS. 9A to 9E, and FIG. 10, some light sources for headlight 100 in which the edge 35 of the reflection surface part for light distribution formation 34 is formed into different shapes will be explained.

First, by inclining the edge 35 of the reflection surface part for light distribution formation 34 in the front-rear direction of the vehicle, the cutoff line CL can be inclined in the vertical direction.

Figure 8:
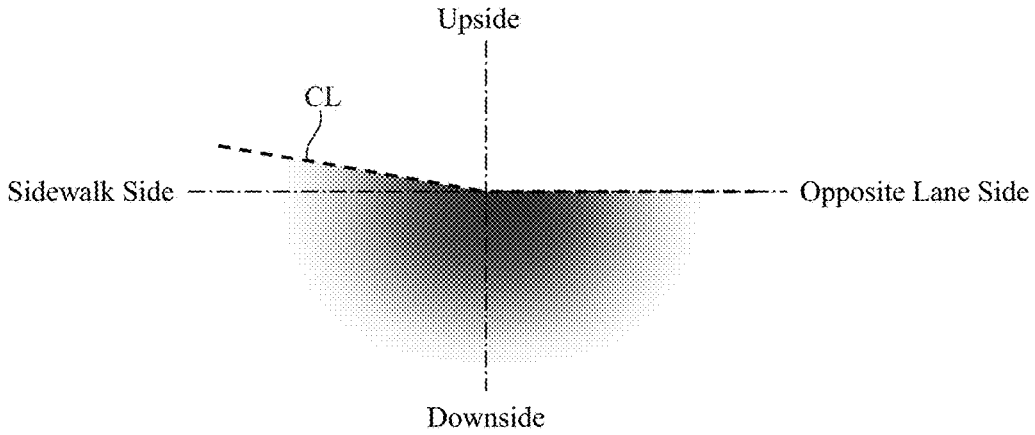
FIG. 8 is an explanatory drawing showing another example of the low-beam light distribution.
Figure 9B:
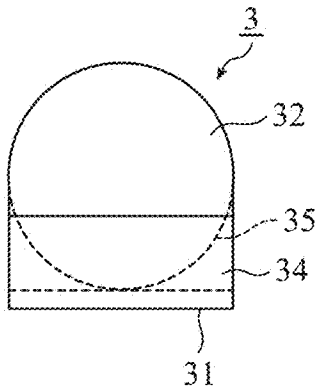
FIG. 9B is a rear view of another example of the light guide member according to Embodiment 1.
Figure 9D:
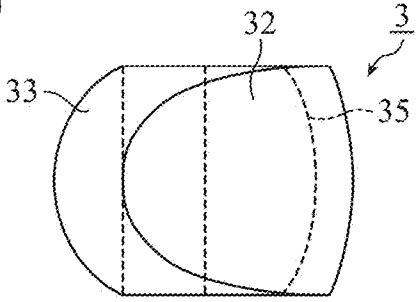
FIG. 9D is a plan view of another example of the light guide member according to Embodiment 1.
Figure 9C:
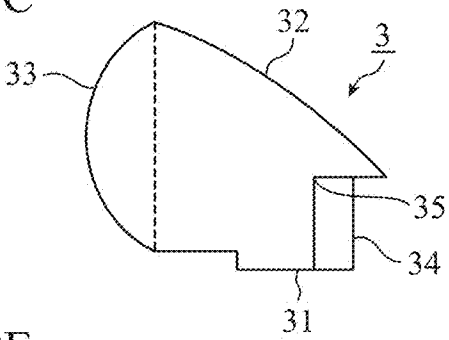
FIG. 9C is a side view of another example of the light guide member according to Embodiment 1.
Figure 9E:
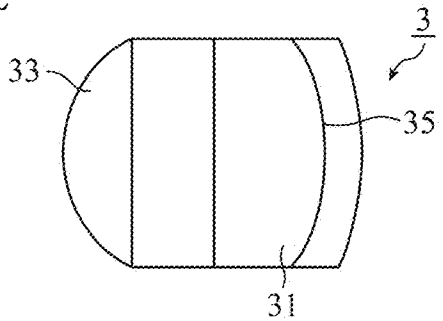
FIG. 9E is a bottom view of another example of the light guide member according to Embodiment 1.
Figure 9A:
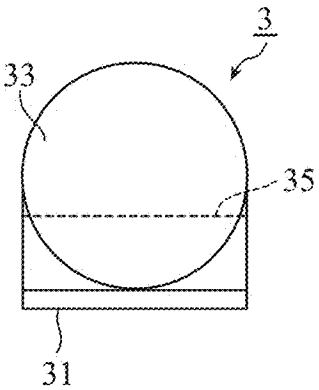
FIG. 9A is a front view of another example of the light guide member according to Embodiment 1.

Concretely, for example, as shown in FIG. 7, one of right and left half portions of the reflection surface part for light distribution formation 34, which corresponds to the light distribution on the sidewalk side, is inclined with respect to the other one of the right and left half portions, toward the rear side of the vehicle. As a result, a half portion of the edge 35 of the reflection surface part for light distribution formation 34, the half portion corresponding to the light distribution on the sidewalk side, is also inclined with respect to another half portion of the edge 35, toward the rear side of the vehicle. As a result, as shown in FIG. 8, in the low-beam light distribution, the cutoff line CL on the sidewalk side can be inclined upward while the cutoff line CL on the side of the opposite lane is leveled.

As an alternative, for example, from the state shown in FIG. 7, by inclining the half portion corresponding to the light distribution on the side of the opposite lane toward a front side of the vehicle, the whole edge 35 of the reflection surface part for light distribution formation 34 may be inclined in the front-rear direction of the vehicle.

In this case, the cutoff line CL has a shape which gradually rises from the opposite lane side thereof toward the sidewalk side thereof.

By inclining a part or all of the cutoff line CL in the low-beam light distribution, to enlarge the illumination area on the sidewalk side in the upward direction relatively to the illumination area on the opposite lane side, a light distribution which prevents the drivers of oncoming vehicles from being dazzled while making it easy for the driver of the user's vehicle to visually recognize the sidewalk can be implemented.

Further, by rotating the light guide member 3 shown in FIG. 1, FIGS. 2A to 2E, and 4 with respect to the optical axis C1 to shift the arrangement position of the light emitting element 1 apart from a portion under the light guide member 3 dependently on the rotation angle, the cutoff line CL can be inclined in the vertical direction. In addition, by inclining the edge 35 in the front-rear direction of the vehicle in the light source for headlight 100 in which the light guide member 3 is rotated as above, the light source for headlight 100 can also be configured in such a way that the cutoff line CL is leveled while the arrangement position of the light emitting element 1 is shifted apart from the portion under the light guide member 3. By thus inclining the edge 35 of the reflection surface part for light distribution formation 34 in the front-rear direction of the vehicle, flexibility of the arrangement of the light emitting element 1 with respect to the cutoff line CL can be increased.

Further, the edge 35 of the reflection surface part for light distribution formation 34 can be formed into a curved shape in such away that the center thereof protrudes, relative to both ends thereof, toward the rear or front side of the vehicle.

Figure 10:
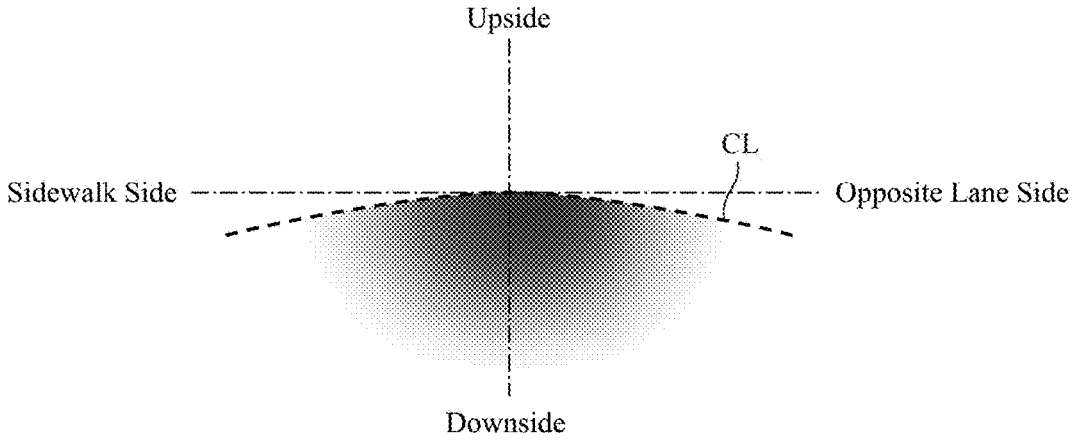
FIG. 10 is an explanatory drawing showing another example of the low-beam light distribution.

For example, as shown in FIG. 9, the edge 35 is designed to be curved in such a way that the center thereof protrudes, relative to both ends thereof, toward the rear side of the vehicle. As a result, as shown in FIG. 10, it is possible to form the cutoff line CL to be curved in such a way that the center thereof protrudes, relative to both ends thereof, upward. Similarly, by designing the edge 35 to be curved in such a way that the center thereof protrudes toward the front side of the vehicle relative to both ends thereof, it is possible to form the cutoff line CL to be curved in such a way that the center thereof protrudes, relative to both ends thereof, downward.

Next, some modifications of the light source for headlight 100 will be explained with reference to FIGS. 11 and 12.

Figure 11:
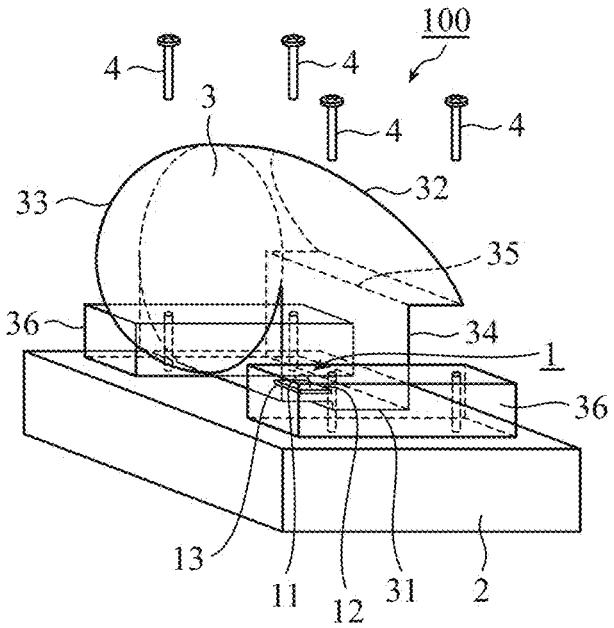
FIG. 11 is a perspective view of another example of the light source for headlight according to Embodiment 1 of the present invention.

As shown in FIG. 11, the light guide member 3 can be configured in such a way that fixing parts 36 are formed integrally with both sides of the light guide member 3, respectively. Each of the fixing parts 36 has screw holes, and is fixed to the fixing member 2 by screws 4. As a result, the number of parts can be reduced in comparison with a configuration employing a fixing member separate from the light guide member 3.

Figure 12:
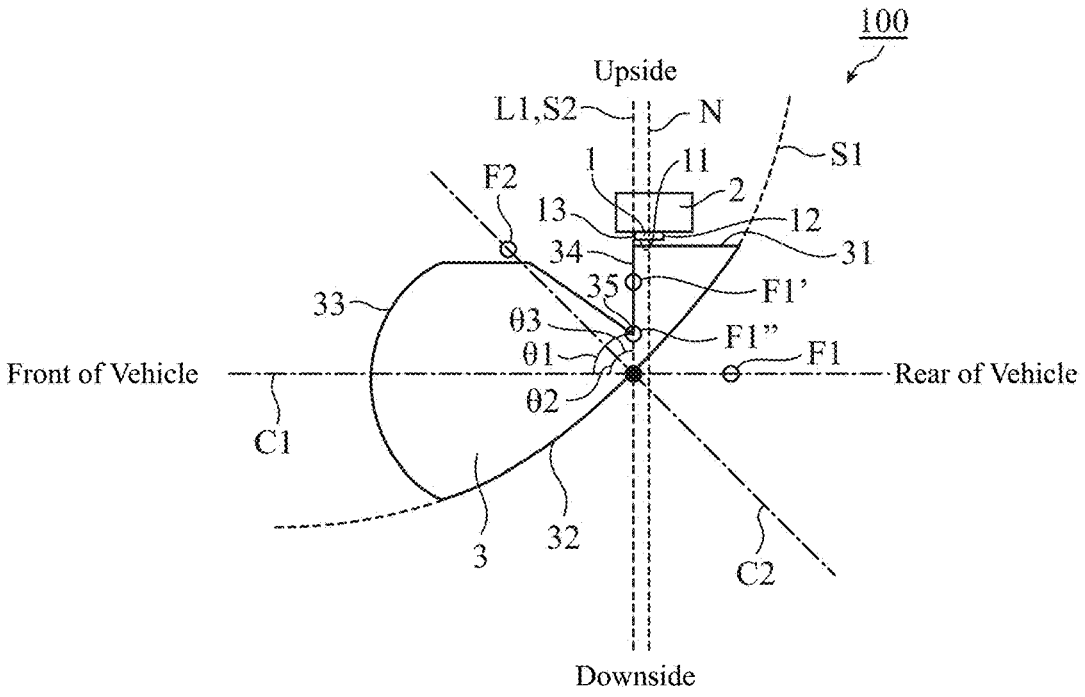
FIG. 12 is a cross-sectional view of another example of the light source for headlight according to Embodiment 1 of the present invention.

Further, as shown in FIG. 12, the light emitting element 1 can be arranged above the optical axis C1 of the projection lens part 33. In FIG. 12, the same parts as those of the light source for headlight 100 shown in FIG. 4 are denoted by the same reference numerals, and the explanation of the parts will be omitted hereafter. In the case in which the light emitting element 1 is arranged above the optical axis C1, an edge 13 of the light emitting surface 11 of the light emitting element 1, the edge being on the front side of the vehicle, is arranged on the surface S2 extending along the reflection surface part for light distribution formation 34. As a result, the whole surface of the light emitting surface 11 is positioned opposite to the incidence surface part 31, so that the utilization efficiency of the light can be increased.

Figure 14:
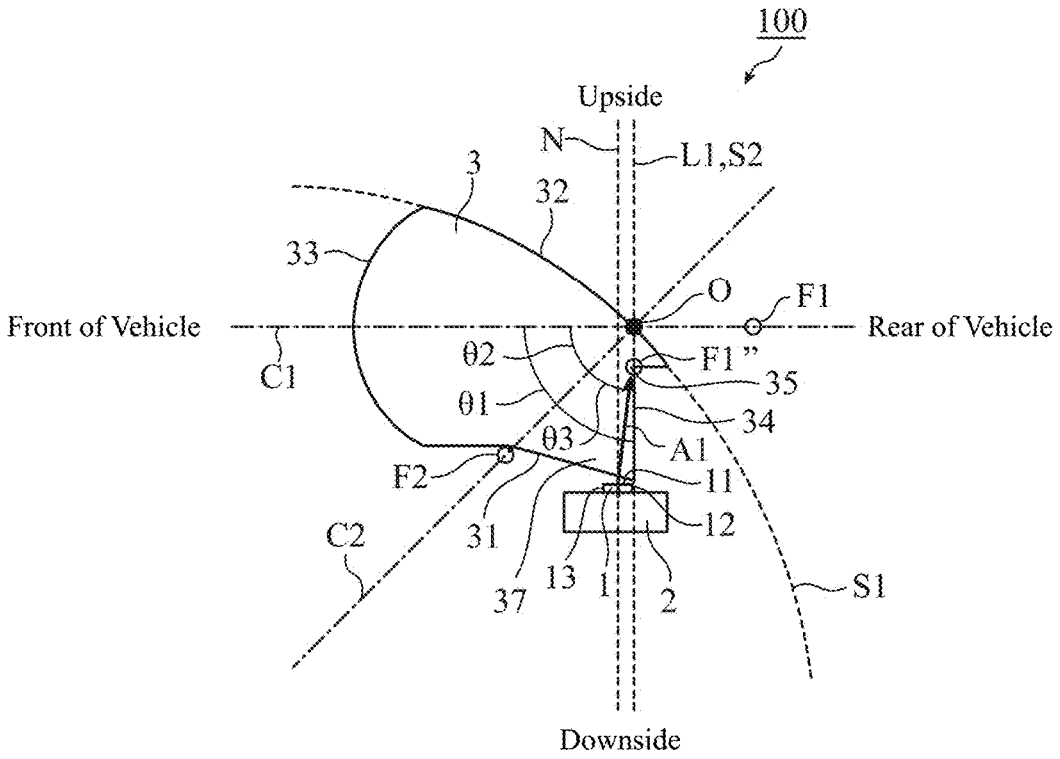
FIG. 14 is a cross-sectional view of another example of the light source for headlight according to Embodiment 2 of the present invention.

In the light source for headlight 100 in which the light emitting element 1 is arranged below the optical axis C1, as shown in FIG. 4, the edge 12 of the light emitting surface 11, the edge being on the rear side of the vehicle, may be arranged closer to the front side of the vehicle with respect to the surface S2. Similarly, in the configuration in which the light emitting element 1 is arranged above the optical axis C1, as shown in FIG. 14, the edge 13 of the light emitting surface 11, the edge being on the front side of the vehicle, may be arranged closer to the rear side of the vehicle with respect to the surface S2. In either of the configurations, the whole surface of the light emitting surface 11 is positioned opposite to the incidence surface part 31, so that the utilization efficiency of the light can be increased.

Further, the optical axis C2 of the reflection surface part 32 can be disposed in such a way that the optical axis C2 is not oriented strictly toward the center of the angle θ1 which the optical axis C1 forms with the straight line L1, and may be oriented in such a way that there is a difference between the angle θ2 and the angle θ3. By at least orienting the optical axis C2 of the reflection surface part 32 in such a way that the optical axis C2 passes between the light emitting element 1 and the projection lens parts 33, the reflection surface part 32 can be made to reflect the light emitted by the light emitting element 1 toward the projection lens part 33.

Further, the reflection surface part 32 may have a reflection structure which differs dependently on the incident angle of the light.

More specifically, the minimum value of the incident angle at which the reflection surface part 32 can total-reflect the light is called the "critical angle", and the value of the critical angle is determined by both the index of refraction of a transparent material which constructs the light guide member 3, and the index of refraction of the air outside the light guide member 3. In a case in which the reflection surface part 32 is oriented in such a way that the incident angle is equal to or larger than the critical angle, the reflection surface part 32 can total-reflect the light at the internal surface portion of the light guide member 3. On the other hand, in a case in which the reflection surface part 32 is oriented in such a way that the incident angle is smaller than the critical angle, the reflection surface part 32 cannot total-reflect the light at the internal surface portion of the light guide member 3, so that a part of the incident light leaks out of the light guide member 3.

Then, in a case in which the reflection surface part 32 is oriented in such a way that the incident angle is smaller than the critical angle, in the reflection surface part 32, the external surface of the light guide member 3 is plated by using, for example, vacuum deposition of metal such as silver or aluminum. By reflecting the light with this plating, the light can be prevented from leaking out of the light guide member 3, so that the utilization efficiency of the light can be increased. Further, instead of the plating, a coating including plural layers of materials having different indices of refraction, respectively, may be laminated on the external surface of the light guide member 3, so that a light reflection layer is formed on the external surface.

In contrast, in a case in which the reflection surface part 32 is oriented in such a way that the incident angle is equal to or larger than the critical angle, the plating or the coating is not required, and the reflection surface part 32 is configured so as to total-reflect the incident light at the internal surface of the light guide member 3. As a result, the manufacturing cost of the light source for headlight 100 can be reduced in comparison with the case in which the plating or the like is required.

Further, the reflection surface part for light distribution formation 34 may form a light distribution of a cornering lamp or a fog lamp instead of or in addition to the low-beam light distribution. Namely, the light source for headlight 100 for low-beam light can also be used as a light source for cornering lamp or a light source for fog lamp. In other words, the use of the light source for headlight 100 for low-beam light is not limited to the low-beam light.

Further, the arrangement position of the combined focal point F1" is not limited to the positions shown in FIGS. 4 and 12. The arrangement position of the combined focal point F1" is determined by the curvature of the reflection surface part 32, the position of the optical center O on the optical axis C1, and so on.

Further, the light emitting surface 11 of the light emitting element 1 and the incidence surface part 31 of the light guide member 3 do not have to be parallel to each other, and the optical axis C1 of the projection lens part 33 and the normal N of the light emitting surface 11 at the central part thereof do not have to be perpendicular to each other.

Further, the headlight in which the light source for headlight 100 according to Embodiment 1 is disposed is not limited to a vehicle-mounted headlight. The light source for headlight 100 can be used for a headlight for any type of moving object including a vehicle, a rail car, a ship, or an airplane.

As described above, a light source for headlight 100 according to Embodiment 1 includes: a light emitting element 1; and a light guide member 3 having a reflection surface part 32 reflecting light emitted by the light emitting element 1, and a projection lens part 33 projecting the light reflected by the reflection surface part 32 onto an area ahead of a moving object. The light emitting element 1 is arranged to be displaced from an optical axis C1 of the projection lens part 33. The reflection surface part 32 is in a shape of a concave mirror having an optical axis C2 and one focal point F2 on the optical axis C2. An optical center O which is an intersection of the reflection surface part 32 and the optical axis C2 of the reflection surface part 32 is arranged on the optical axis C1 of the projection lens part 33 and between the projection lens part 33 and a focal point F1 of the projection lens part 33. The optical axis C2 of the reflection surface part 32 is oriented in a direction passing a position between a central part of a light emitting surface of the light emitting element 1 and a central part of the projection lens part 32.

With a configuration in which the projection lens part 33 in the shape of a convex lens further focuses light focused by the reflection surface part 32 in the shape of a concave mirror, an auxiliary convex lens becomes unnecessary so that the number of parts is reduced, and the focal length can be shortened so that the light source for headlight 100 can be further downsized. Further, in comparison with the configuration of shortening the focal length of the projection lens part 33 by increasing the curvature of the projection lens part 33, the forming of the projection lens part 33 can be facilitated, the forming accuracy can be increased, and the aberration of the projection lens part 33 can be reduced.

Further, the light source for headlight 100 is a light source for low-beam light. The light guide member 3 has a reflection surface part for light distribution formation 34 disposed between the light emitting element 1 and the reflection surface part 32. An edge 35 of the reflection surface part for light distribution formation 34, the edge being on a side of the reflection surface part 32, is arranged at a combined focal point F1" of the projection lens part 33 and the reflection surface part 32. The optical axis C2 of the reflection surface part 32 is oriented toward a center of an angle θ1 which the optical axis C1 of the projection lens part 33 forms with a straight line L1 passing through the optical center O of the reflection surface part 32 and a central part of the edge 35 of the reflection surface part for light distribution formation 34, the edge being on a side of the reflection surface part 32. By disposing the reflection surface part for light distribution formation 34, the light source for low-beam light can be configured. Further, this light source for low-beam light can also be used as a light source for a vehicle-mounted cornering lamp or a light source for a vehicle-mounted fog lamp.

Further, The light emitting element 1 is arranged above the optical axis C1 of the projection lens part 33. An edge 13 of the light emitting surface 11 of the light emitting element 1, the edge being on a front side of the moving object, is arranged either on a surface S2 extending along the reflection surface part for light distribution formation 34, or closer to a rear side of the moving object with respect to the surface S2 extending along the reflection surface part for light distribution formation 34. Alternatively, in the light source for headlight 100, the light emitting element 1 is arranged below the optical axis C1 of the projection lens part 33. An edge 12 of the light emitting surface 11 of the light emitting element 1, the edge being on a rear side of the moving object, is arranged either on a surface S2 extending along the reflection surface part for light distribution formation 34, or closer to a front side of the moving object with respect to the surface S2 extending along the reflection surface part for light distribution formation 34. As a result, the whole surface of the light emitting surface 11 is positioned opposite to the incidence surface part 31, so that the utilization efficiency of the light can be increased.

Further, the edge 35 of the reflection surface part for light distribution formation 34, the edge being on the side of the reflection surface part 32, is formed into a curved shape in such a way that both ends thereof are closer to the optical axis C1 of the projection lens part 33 than a center thereof. By matching the curvature of the edge 35 with that of the projection lens part 33, the whole edge 35 of the reflection surface part for light distribution formation 34 is arranged at the combined focal point F1" of the projection lens part 33 and the reflection surface part 32, and the whole cutoff line CL in the low-beam light distribution can be made sharper.

Further, the edge 35 of the reflection surface part for light distribution formation 34, the edge being on the side of the reflection surface part 32, is shaped in such a way that at least a part thereof is inclined in a front-rear direction of the moving object. As a result, a light distribution in which the cutoff line CL on the sidewalk side is inclined upward can be formed, and the degree of flexibility of the arrangement of the light emitting element 1 for a required cutoff line CL can be increased.

Further, the edge 35 of the reflection surface part for light distribution formation 34, the edge being on the side of the reflection surface part 32, is formed into a curved shape in such a way that a center thereof protrudes toward a rear or front side of the moving object in comparison with both ends thereof. As a result, a light distribution in which the cutoff line CL is curved in the vertical direction can be formed.

Further, the reflection surface part 32 is configured so as to receive incident light emitted by the light emitting element 1 incident to the reflection surface part at an angle equal to or larger than a critical angle and reflect the incident light at an internal surface portion of the light guide member 3, or so as to reflect incident light emitted by the light emitting element 1 with a plating or a coating formed on an external surface portion of the light guide member 3. In the case in which the reflection surface part 32 is oriented in such a way that the incident angle is smaller than the critical angle, by reflecting the light with the plating or the coating, the light can be prevented from leaking out of the light guide member 3, so that the utilization efficiency of the light can be increased. On the other hand, in the case in which the reflection surface part 32 is oriented in such a way that the incident angle is equal to or larger than the critical angle, the plating or the coating becomes unnecessary, and the manufacturing cost of the light source for headlight 100 can be reduced.

Embodiment 2

Some modifications of the light source for headlight 100 will be explained with reference to FIGS. 13 to 20. Every light source for headlight 100 shown in FIGS. 13 to 20 is a light source for low-beam light and used for vehicle-mounted headlight similarly to the case in Embodiment 1. In FIGS. 13 to 20, the same parts as those of the light source for headlight 100 according to Embodiment 1 shown in FIG. 1, FIGS. 2A to 2E, and FIG. 4 are denoted by the same reference numerals, and the explanation of the parts will be omitted hereafter.

Figure 13:
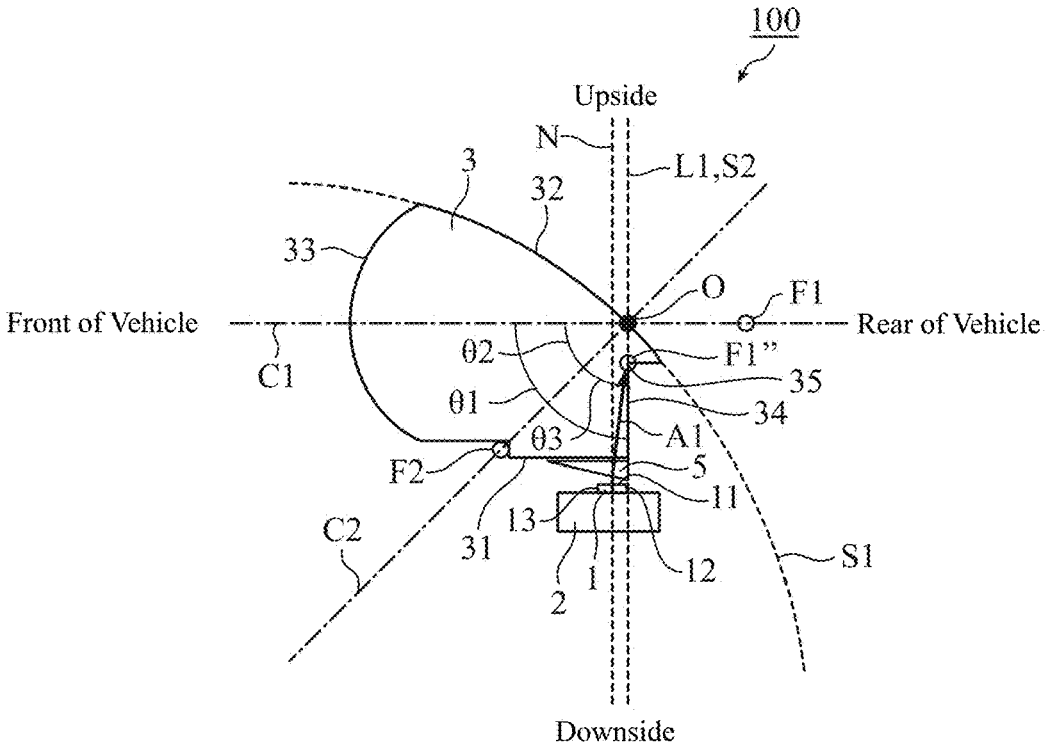
FIG. 13 is a cross-sectional view of a light source for headlight according to Embodiment 2 of the present invention.

In the light source for headlight 100 shown in FIG. 13, a refracting member 5 is disposed between the light emitting surface 11 of the light emitting element 1 and the incidence surface part 31 of the light guide member 3. The refracting member 5 is made of, for example, a transparent resin, such as acrylics or polycarbonate, or glass. The refracting member 5 has a cross section shaped like a wedge, as shown in FIG. 13, and refracts the light emitted by the light emitting element 1 so that the light enters the incidence surface part 31.

The refracting member 5 refracts the light emitted from the central part of the light emitting surface 11 of the light emitting element 1 in such a way that the light travels toward the central part of the edge 35 of the reflection surface part for light distribution formation 34, the edge being on the side of the reflection surface part 32, as shown by an arrow A1 in the figure. As a result, in the low-beam light distribution, a light distribution which has the highest degree of brightness just below the central part of the cutoff line and gradually becomes dark with the distance from the central part can be acquired.

When both right and left ends of the low-beam light distribution are made too bright, the boundary between the illuminated area and a dark area outside the illuminated area is conspicuous, and which is felt unnatural by the driver. Further, when a lower edge portion of the low-beam light distribution is made too bright, such a light distribution rather makes it difficult for the driver to recognize an area ahead of the vehicle, because the light is reflected on the road. In contrast with these cases, by providing the low-beam light distribution in which the brightness is the highest just below the central part of the cutoff line and gradually becomes dark with the distance from the central part, the light distribution can reduce the driver's feeling of unnaturalness and makes it possible for the driver to easily recognize an area ahead of the vehicle.

In the light source for headlight 100 shown in FIG. 14, a refracting part 37 is formed by inclining a part of the incidence surface part 31 of the light guide member 3 with respect to the light emitting surface 11 of the light emitting element 1. Namely, the refracting part 37 is formed integrally with the light guide member 3. The refracting part 37 refracts the light emitted by the light emitting element 1 like the refracting member 5 shown in FIG. 13. As a result, a light distribution which reduces the driver's feeling of unnaturalness and makes it easy for the driver to recognize an area ahead of the vehicle can be implemented like the light source for headlight 100 shown in FIG. 13. Further, a refracting member separate from the light guide member 3 is not required so that the number of parts can be reduced and the manufacturing cost of the light source for headlight 100 can be reduced.

Figure 15:
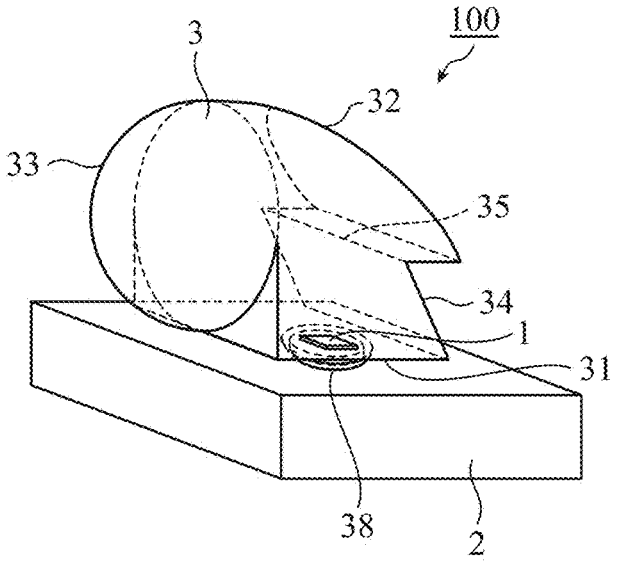
FIG. 15 is a perspective view of another example of the light source for headlight according to Embodiment 2 of the present invention.
Figure 16:
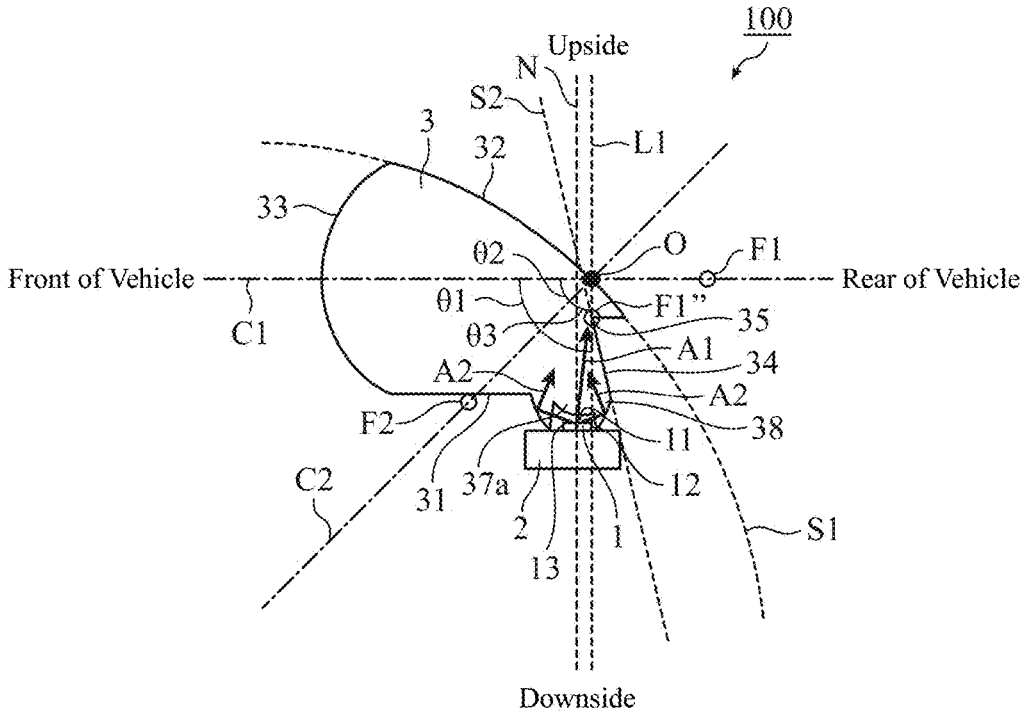
FIG. 16 is a cross-sectional view of the light source for headlight shown in FIG. 15.

In the light source for headlight 100 shown in FIGS. 15 and 16, a refracting part 37*a* and an incidence part 38 are disposed in the incidence surface part 31 of the light guide member 3. The refracting part 37*a* refracts the light emitted by the light emitting element 1 like the refracting part 37 shown in FIG. 14. As a result, the same light distribution as that implemented by the light source for headlight 100 shown in FIGS. 13 and 14 can be implemented.

In general, light which is emitted by a semiconductor light emitting element, such as an LED, from the light emitting surface 11 thereof is diffused light, and in addition to emitting the strongest light in the direction along the normal N, weak light is emitted in directions other than the direction of the normal N. The incidence part 38 reflects light traveling toward directions different from the direction of the normal N, the light being included in the light emitted by the light emitting element 1, toward either the reflection surface part 32 or the reflection surface part for light distribution formation 34, as shown by an arrow A2 in the figure. In a configuration not having the incidence part 38, because these light beams do not enter the light guide member 3 and therefore cannot be used for the formation of a light distribution, the utilization efficiency of the light is decreased. By disposing the incidence part 38, these light beams can also be used for the formation of a light distribution, and therefore the utilization efficiency of the light can be increased.

Figure 17:
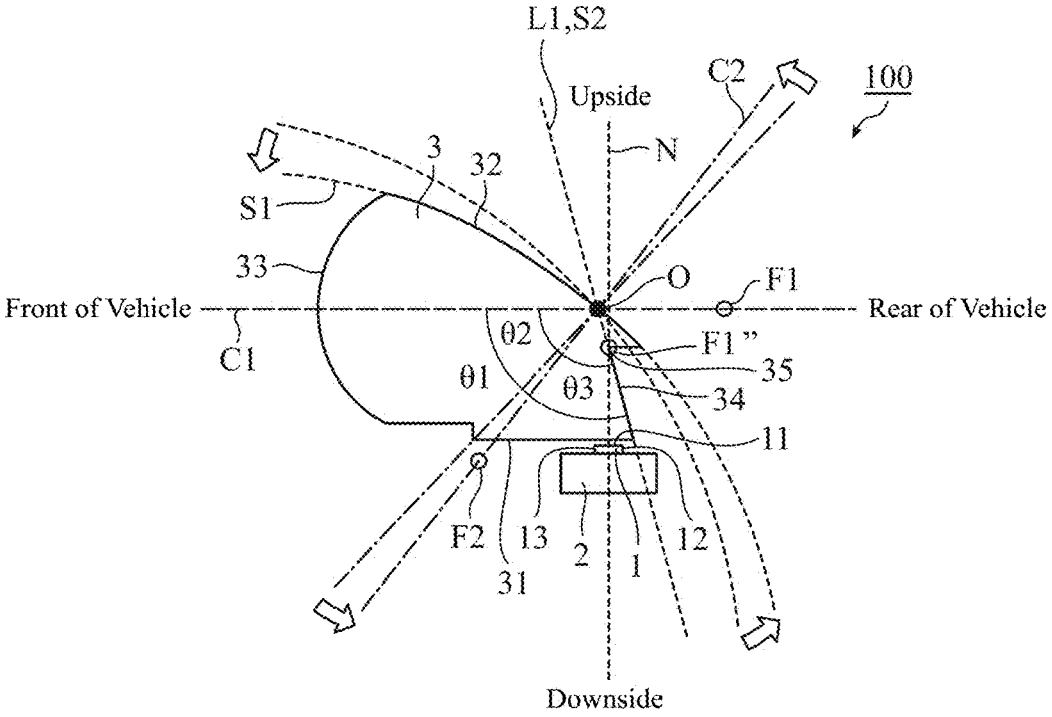
FIG. 17 is a cross-sectional view of another example of the light source for headlight according to Embodiment 2 of the present invention.

In the light source for headlight 100 shown in FIG. 17, the installation angle of the reflection surface part 32 is inclined compared with the configuration of the light source for headlight 100 according to Embodiment 1 shown in FIG. 4. Concretely, the light source for headlight 100 is rotated 0 about the optical center O of the reflection surface part 32 serving as a fulcrum in such a way that the vehicle front side thereof is shifted downward and the vehicle rear side thereof is shifted upward. In association with the rotation of the reflection surface part 32, the paraboloid S1 along which the reflection surface part 32 extends is also rotated, and the optical axis C2 of the reflection surface part 32 is also rotated.

Further, in association with the rotation of the reflection surface part 32, the angle θ1 which the optical axis C1 of the projection lens part 33 forms with the straight line L1 passing through the optical center O and the central part of the edge 35 becomes larger than 90 degrees. As a result, the angle θ2 which the optical axis C1 forms with the optical axis C2 becomes larger than 45 degrees, and the angle θ3 which the straight line L1 forms with the optical axis C2 becomes larger than 45 degrees.

In the example shown in FIG. 17, the angle θ1 is larger than 90 degrees, and the surface S2 extending along the reflection surface part for light distribution formation 34 is in the shape of a plane extending along the straight line L1. As a result of such a configuration, the edge 12 of the light emitting surface 11 of the light emitting element 1, the edge being on the rear side of the vehicle, is arranged closer to the front side of the vehicle with respect to the surface S2 while the normal N of the light emitting surface 11 of the light emitting element 1 at the central part of the light emitting surface 11 can be oriented toward the central part of the edge 35 of the reflection surface part for light distribution formation 34, the edge being on a side of the reflection surface part 32. Namely, the whole surface of the light emitting surface 11 is positioned opposite to the incidence surface part 31, so that the utilization efficiency of the light can be increased while the refracting member 5 shown in FIG. 13 and the refracting part 37 shown in FIG. 14 are not required, and the low-beam light distribution which has the highest degree of brightness just below the central part of the cutoff line can be formed. Further, because the light emitting surface 11 and the incidence surface part 31 are parallel to each other, undesired reflection of light by the inclined incidence surface which may occur in a configuration in which either the refracting member 5 or the refracting part 37 is disposed is prevented, so that the utilization efficiency of the light can be further increased.

Figure 18:
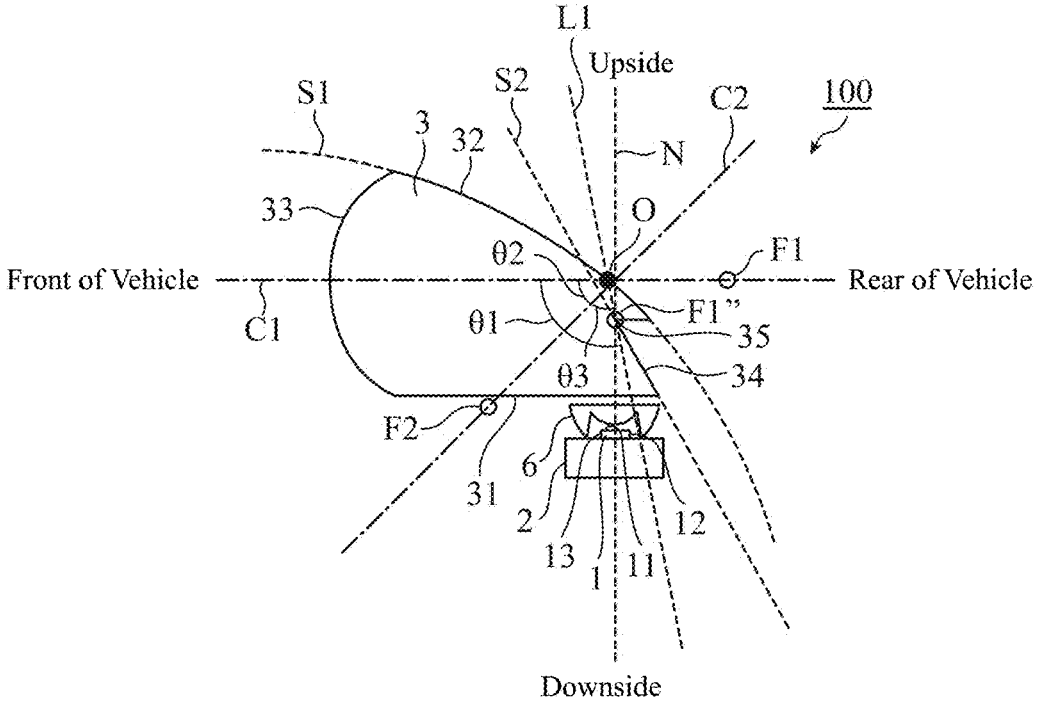
FIG. 18 is a cross-sectional view of another example of the light source for headlight according to Embodiment 2 of the present invention.

In the light source for headlight 100 shown in FIG. 18, an incidence member 6 is added between the light emitting surface 11 of the light emitting element 1 and the incidence surface part 31 of the light guide member 3 to the configuration of the light source for headlight 100 shown in FIG. 17. The incidence member 6 reflects light traveling toward directions different from the direction of the normal N, the light being included in the light emitted by the light emitting element 1, toward either the reflection surface part 32 or the reflection surface part for light distribution formation 34, like the incidence part 38 shown in FIGS. 15 and 16. By guiding these light beams into the light guide member 3, and then using the light beams for the formation of a light distribution, the utilization efficiency of the light can be increased.

Because the strongest light traveling along the normal N travels toward the central part of the edge 35 due to the rotation of the reflection surface part 32, without refracting the incident light, the refracting part 37*a* as shown in FIGS. 15 and 16 is not required.

Figure 19:
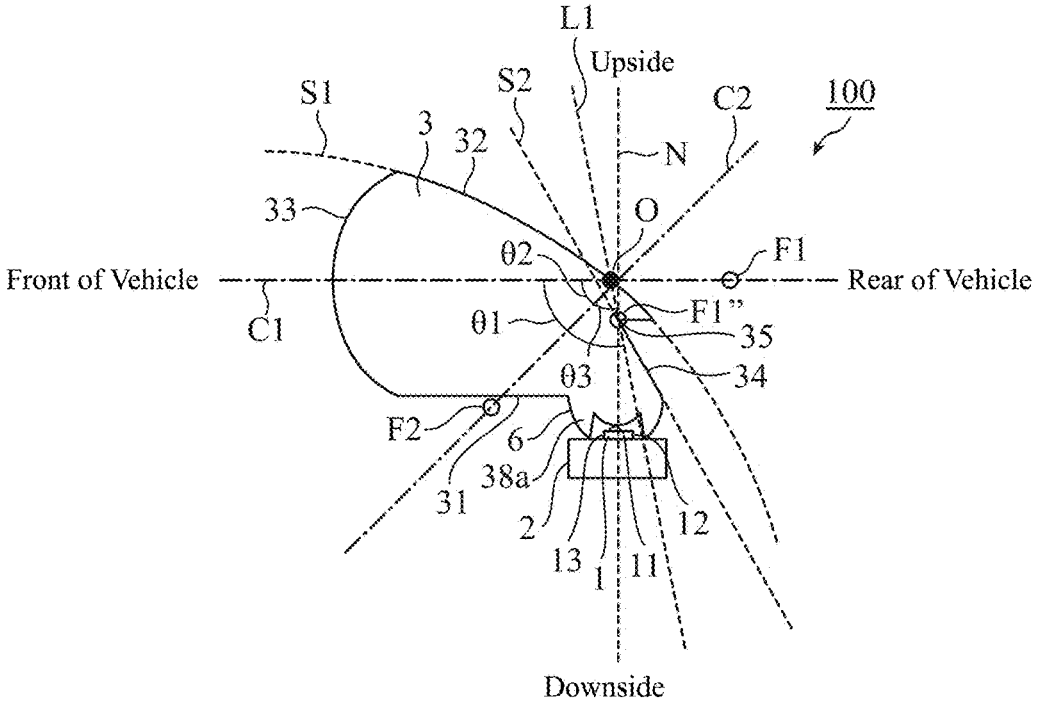
FIG. 19 is a cross-sectional view of another example of the light source for headlight according to Embodiment 2 of the present invention.

In the light source for headlight 100 shown in FIG. 19, an incidence part 38*a* having the same shape as the incidence member 6 shown in FIG. 18 is formed integrally with the incidence surface part 31 of the light guide member 3. As a result, the utilization efficiency of the light can be increased, like in the case of the light source for headlight 100 shown in FIG. 18, while an incidence member separate from the light guide member 3 is not required so that the number of parts is reduced, and the manufacturing cost of the light source for headlight 100 can be reduced.

Figure 20:
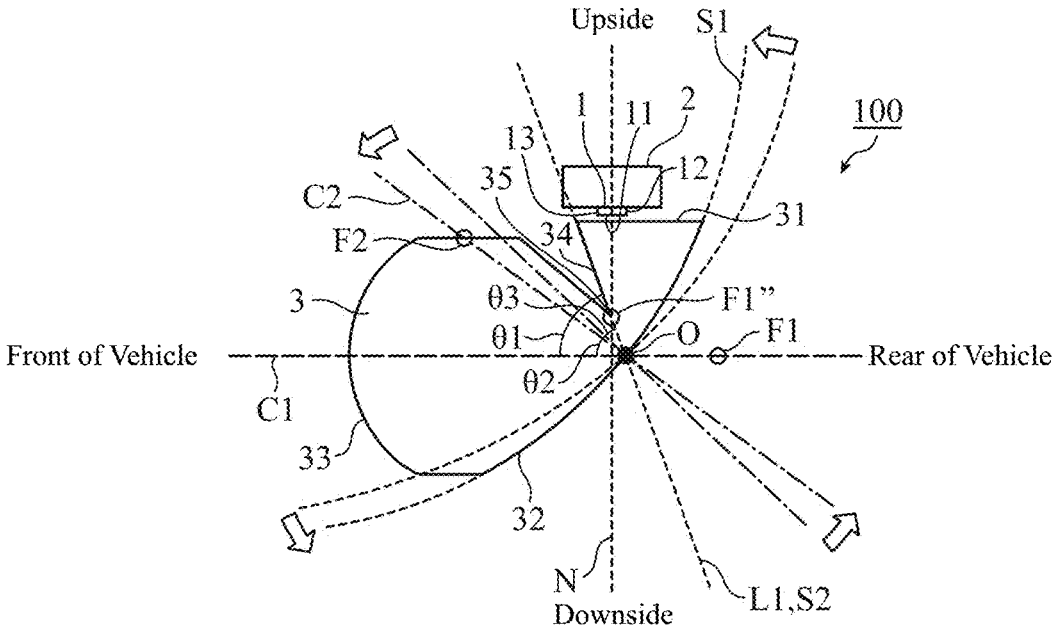
FIG. 20 is a cross-sectional view of another example of the light source for headlight according to Embodiment 2 of the present invention.

In the light source for headlight 100 shown in FIG. 20, the installation angle of the reflection surface part 32 is inclined compared with the configuration of the light source for headlight 100 according to Embodiment 1 shown in FIG. 12. Concretely, the light source for headlight 100 is rotated about the optical center O of the reflection surface part 32 serving as a fulcrum in such a way that the vehicle front side thereof is shifted downward and the vehicle rear side thereof is shifted upward. In association with the rotation of the reflection surface part 32, the paraboloid S1 and the optical axis C2 are also rotated, and the angle θ1 becomes smaller than 90 degrees and each of the angles θ2 and θ3 becomes smaller than 45 degrees. The operation and advantages of the light source for headlight 100 shown in FIG. 20 are the same as those of the light source for headlight 100 shown in FIG. 17.

The headlight in which the light source for headlight 100 according to Embodiment 2 is disposed is not limited to a vehicle-mounted headlight. The light source for headlight 100 can be used for a headlight for any type of moving object including a vehicle, a rail car, a ship, or an airplane.

As described above, in the light source for headlight 100 according to Embodiment 2, the normal N of the light emitting surface 11 of the light emitting element 1 at the central part thereof is oriented toward the central part of the edge 35 of the reflection surface part for light distribution formation 34, the edge being on a side of the reflection surface part 32. As a result, a light distribution which has the highest degree of brightness just below the central part of the cutoff line and gradually becomes dark with the distance from the central part can be formed. Namely, a low-beam light which reduces the driver's feeling of unnaturalness and makes it easy for the driver to recognize an area ahead of the moving object can be implemented.

Further, the light emitting element 1 is arranged outside the light guide member 3, and the incidence member 6 for guiding the light emitted by the light emitting element 1 into the light guide member 3 is disposed. The incidence member 6 makes it possible to also use light traveling toward directions different from the direction of the normal N, the light being included in the light emitted by the light emitting element 1, for the light distribution of the light source for headlight 100, so that the utilization efficiency of the light can be further increased.

Embodiment 3

A light source for headlight 100 in which a light emitting element 1 is enclosed in a light guide member 3 will be explained with reference to FIGS. 21 to 28. Further, in addition to a light source for low-beam light which is used for a vehicle-mounted headlight and which is the same as those according to Embodiments 1 and 2, a light source for high-beam light and a light source for specific direction illumination light will also be explained. In FIGS. 21 to 23, 25, and 28, the same parts as those of the light source for headlight 100 according to Embodiment 1 shown in FIG. 1, FIGS. 2A to 2E, and FIG. 4 are denoted by the same reference numerals, and the explanation of the parts will be omitted hereafter.

Figure 21:
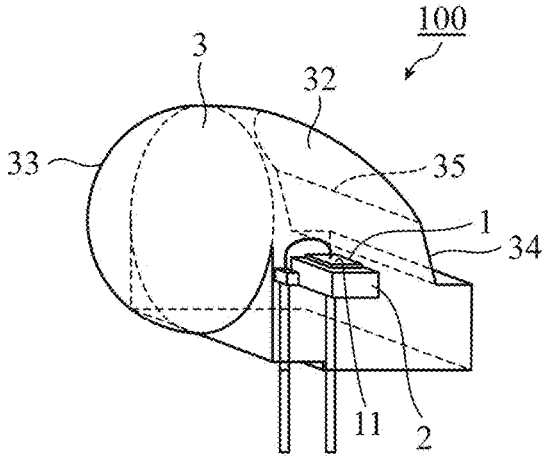
FIG. 21 is a perspective view of a light source for headlight according to Embodiment 3 of the present invention.
Figure 22:
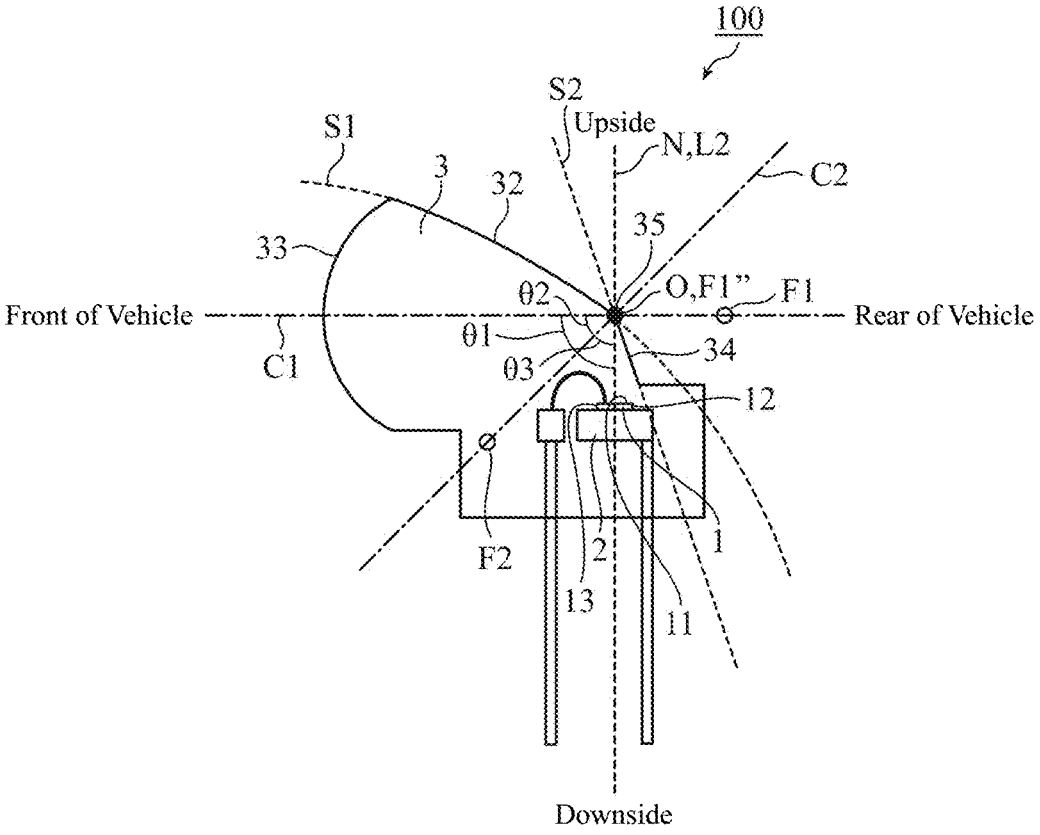
FIG. 22 is a cross-sectional view of the light source for headlight shown in FIG. 21.

The light source for headlight 100 shown in FIGS. 21 and 22 is a light source for low-beam light in which a light emitting element 1 is enclosed in a light guide member 3. In the example of FIGS. 21 and 22, a combined focal point F1" of a projection lens part 33 and a reflection surface part 32 is arranged on the reflection surface part 32, and overlaps an optical center O. Therefore, the central part of an edge 35 of a reflection surface part for light distribution formation 34, the edge being on a side of the reflection surface part 32, also overlaps the optical center O. In this case, the optical axis C2 of the reflection surface part 32 is oriented toward the center of an angle θ1' which the optical axis C1 of the projection lens part 33 forms with a straight line L2 passing through the optical center O of the reflection surface part 32 and the central part of a light emitting surface 11 of the light emitting element 1. In the example of FIGS. 21 and 22, the straight line L2 is perpendicular to the optical axis C1, and the straight line L2 overlaps the normal N. An angle θ2' which the optical axis C1 forms with the optical axis C2 is 45 degrees, and an angle θ3' which the straight line L2 forms with the optical axis C2 is 45 degrees.

Figure 23:
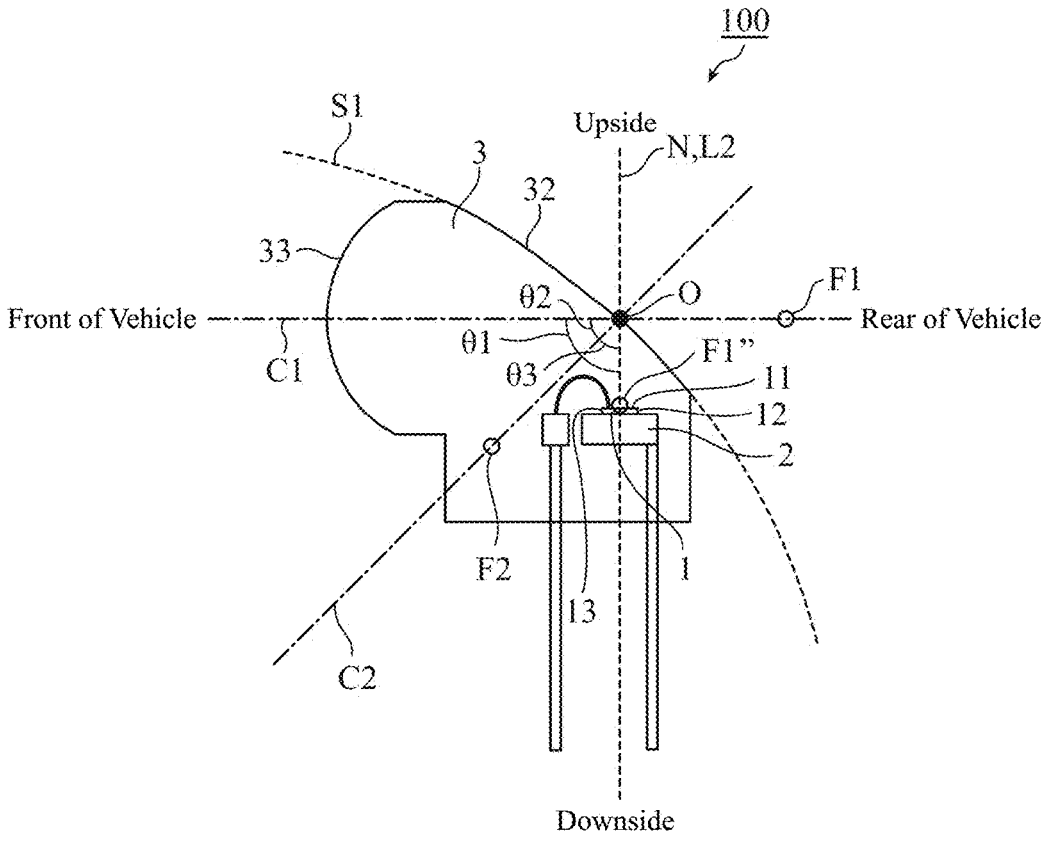
FIG. 23 is a cross-sectional view of another example of the light source for headlight according to Embodiment 3 of the present invention.

The light source for headlight 100 shown in FIG. 23 is a light source for high-beam light in which the light emitting element 1 is enclosed in the light guide member 3. In the light source for high-beam light, a reflection surface part for light distribution formation used in a low-beam light is not required. Further, the central part of the light emitting surface 11 of the light emitting element 1 is arranged at the combined focal point F1" of the projection lens part 33 and the reflection surface part 32.

Figure 24:
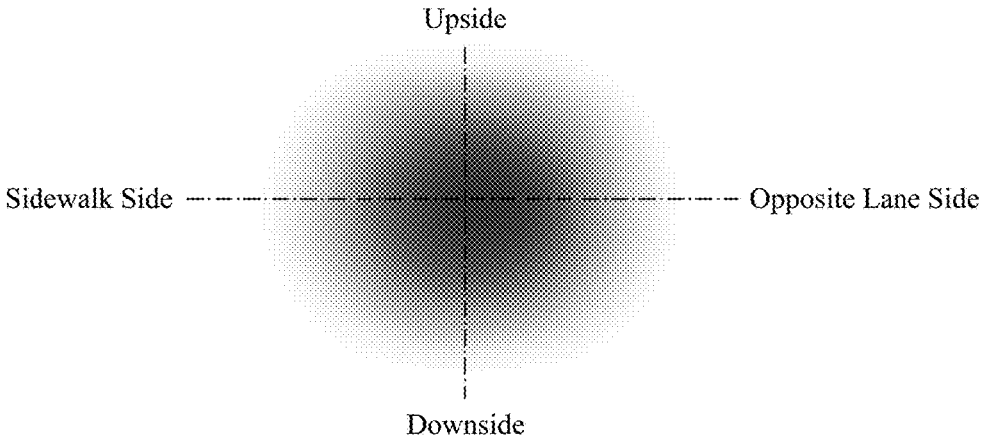
FIG. 24 is an explanatory drawing showing an example of the light distribution of a high-beam light.

By arranging the light emitting surface 11 of the light emitting element 1 at the combined focal point F1", the shape of the light emitting surface 11 is not imaged on an area ahead of the vehicle. Namely, strong light emitted from the light emitting surface 11 in the direction of the normal N is irradiated horizontally onto an area ahead of the vehicle while weak light emitted from the light emitting surface 11 in directions other than the direction of the normal N is irradiated onto surrounding areas, so that the light distribution of a high-beam light can be formed as shown in FIG. 24.

The light source for headlight 100 shown in FIG. 23 can implement the light distribution of a vehicle-mounted daytime running lamp (DRL) by decreasing (attenuating) the intensity of the light emitted by the light emitting element 1. Namely, the light source for headlight 100 for high-beam light can also be used as a light source for DRL. In this way, the use of the light source for headlight 100 for high-beam light is not limited to the high-beam light.

Figure 25:
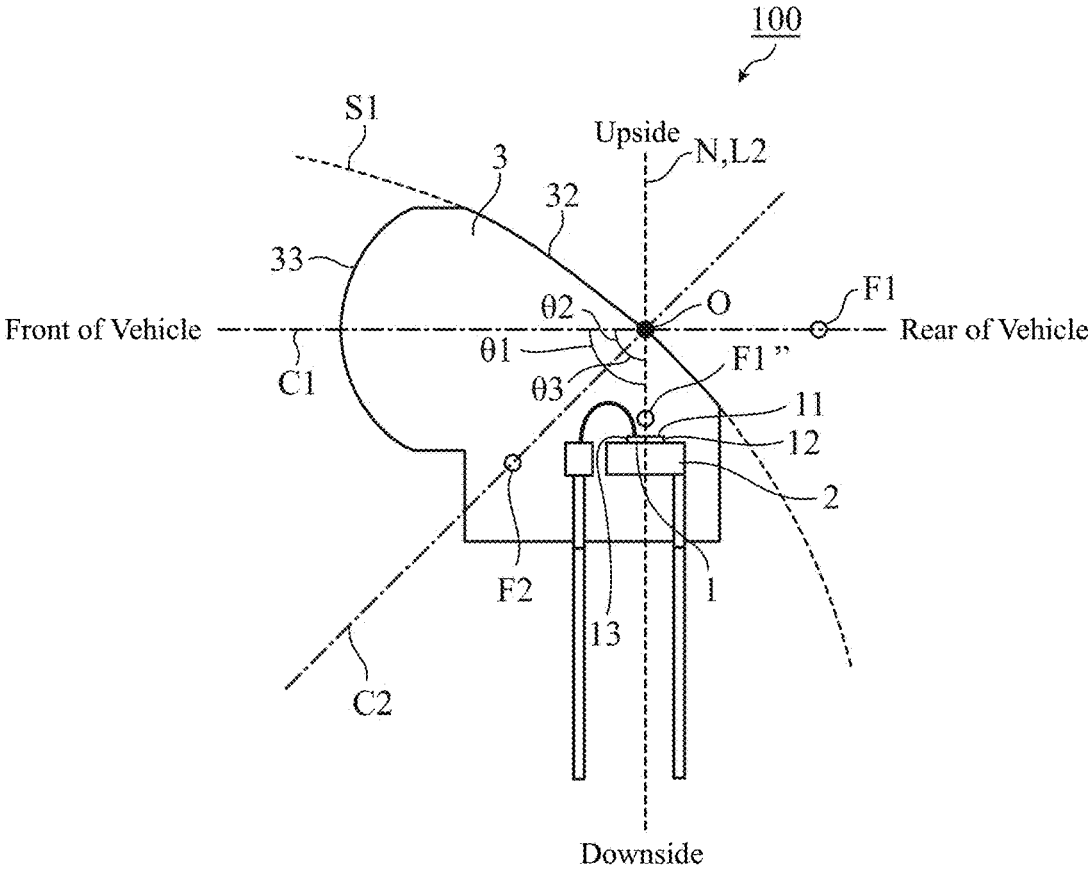
FIG. 25 is a cross-sectional view of another example of the light source for headlight according to Embodiment 3 of the present invention.

The light source for headlight 100 shown in FIG. 25 is a light source for specific direction illumination light in which the light emitting element 1 is enclosed in the light guide member 3. The light source for headlight 100 which is used for a specific direction illumination light is the same as the light source for headlight 100 shown in FIG. 23 which is used for a high-beam light, with the exception that the central part of the light emitting surface 11 of the light emitting element 1 is arranged apart from the optical axis C1 of the projection lens part 33 at a longer distance than the combined focal point F1" of the projection lens part 33 and the reflection surface part 32.

Figure 26:
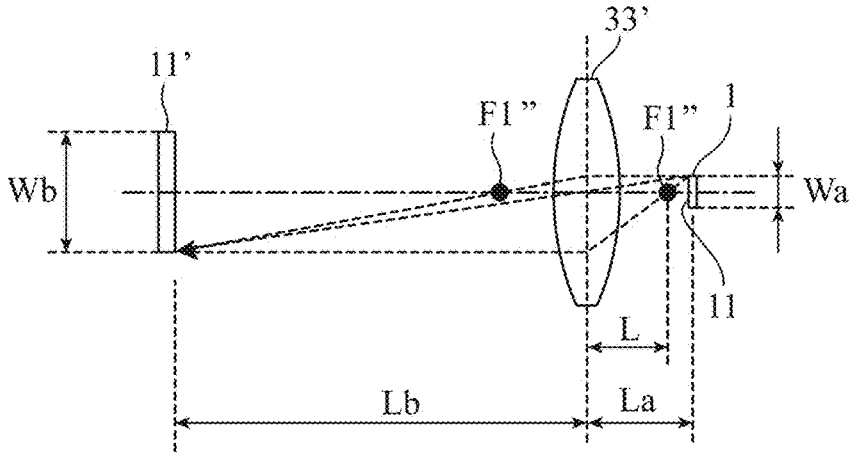
FIG. 26 is an explanatory drawing showing the principle of a specific direction illumination light.

The principle of the specific direction illumination light will be explained with reference to FIG. 26. A convex lens 33' shown in FIG. 26 is a virtual lens having optical characteristics of a combination of the projection lens part 33 and the reflection surface part 32. As shown in FIG. 26, because the light emitting element 1 is arranged apart from the convex lens 33' at a longer distance than the focal point F1" of the convex lens 33', a real image 11' is imaged. The shape of the real image 11' is the same as the shape of the light emitting surface 11 of the light emitting element 1.

In this case, the distance between the convex lens 33' and the light emitting surface 11 is denoted by La, the distance between the convex lens 33' and the real image 11' is denoted by Lb, the width of the light emitting surface 11 of the light emitting element 1 is denoted by Wa, and the width of the real image 11' is denoted by Wb. La, Lb, Wa, and Wb satisfy a relationship shown by the following equation (1).

$$Wb/Wa \approx Lb/La \quad (1)$$

Figure 27:
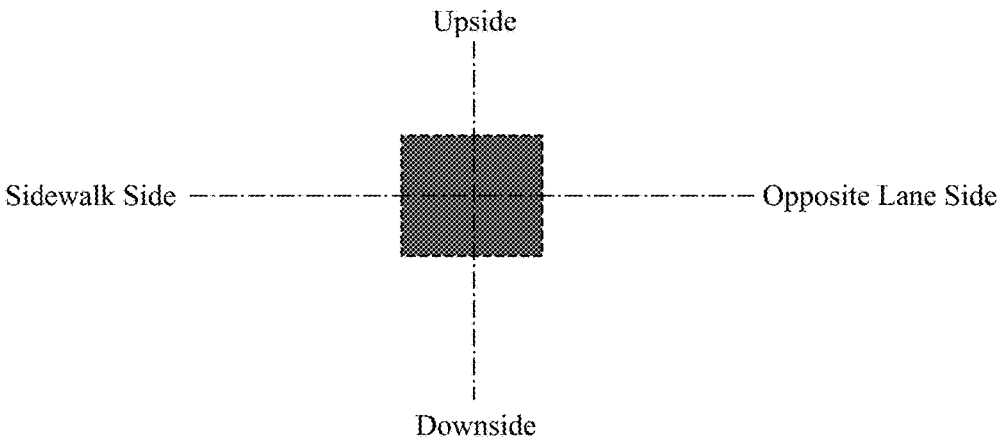
FIG. 27 is an explanatory drawing showing an example of a light distribution of the specific direction illumination light.

Namely, the real image 11' has an enlarged size which is Lb/La times as large as the light emitting surface 11. As a result, as shown in FIG. 27, the light distribution of the specific direction illumination light which illuminates only a specific area which is included in an area ahead of the vehicle and which has the same shape as the light emitting surface 11 and is larger than the light emitting surface 11 in size can be implemented.

When the focal length of the convex lens 33' is denoted by L (i.e., L is equal to f1+f2" shown in FIG. 4), Lb/La is expressed by the following equation (2).

$$Lb/La = 1/\{(La/L)-1\} \quad (2)$$

Namely, the magnification of the real image 11' to the light emitting surface 11 can be set in accordance with the space between the light emitting surface 11 and the focal point F1". Concretely, for example, by making the space between the light emitting surface 11 and the focal point F1" equal to 1/100 of the focal length of the convex lens 33', i.e., 1/100 of the combined focal length of the projection lens part 33 and the reflection surface part 32, the size of the real image 11', i.e., the size of the area illuminated with the specific direction illumination light can be made 100 times as large as the area of the light emitting surface 11. Similarly, by making the space between the light emitting surface 11 and the focal point F1" equal to 1/1,000 of the combined focal length, the size of the area illuminated with the specific direction illumination light can be made 1,000 times as large as the area of the light emitting surface 11.

By disposing a plurality of light sources for specific direction illumination light in a headlight, and, with setting the illumination areas of the light sources to be different from one another, controlling switching on and off of each of the light sources individually, it is possible, for example, to illuminate an obstacle existing ahead of the vehicle brightly, so that the driver's attention is drawn. As an alternative, by selectively switching off light sources each of which irradiates light to oncoming vehicles, a light distribution which prevents the drivers of oncoming vehicles from being dazzled like in the case of the low-beam light, while making it easy for the driver of the user's vehicle to visually recognize an area excluding oncoming vehicles can be implemented.

The light source for headlight 100 which is used for a specific direction illumination light can also be used as a light source for sign pole illumination which irradiates light to a motorway direction sign (a so-called "sign pole") during travel of the vehicle. In this way, the use of the light source for headlight 100 for specific direction illumination light is not limited to the above-mentioned light source.

Figure 28:
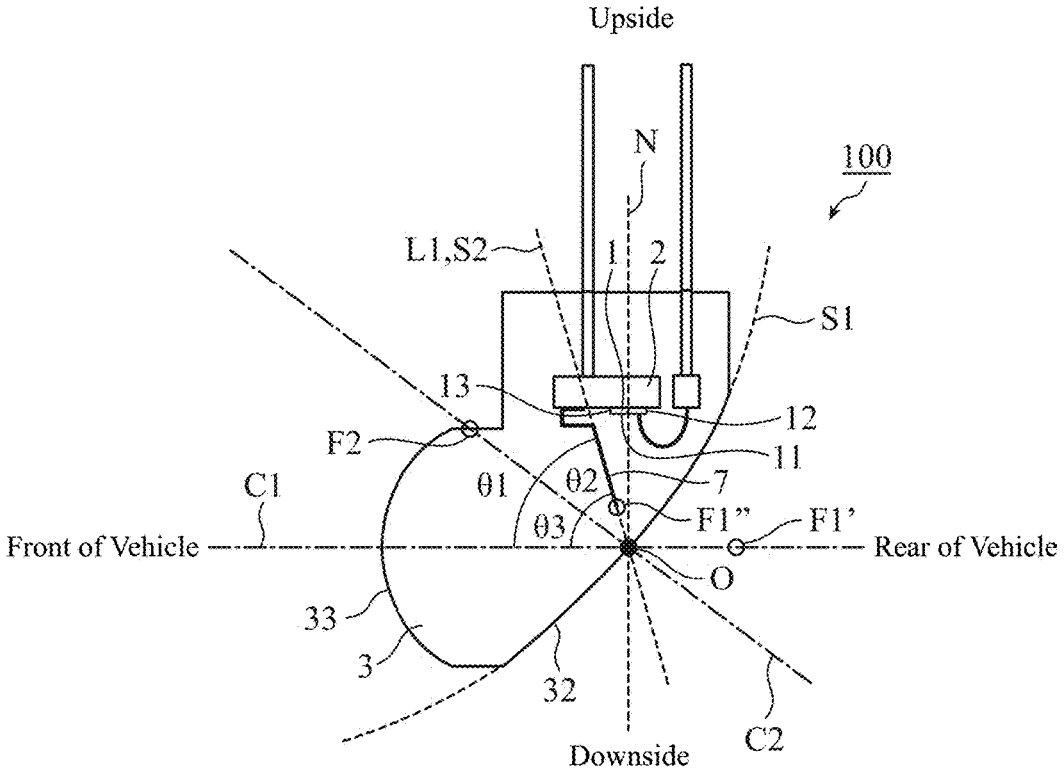
FIG. 28 is a cross-sectional view of another example of the light source for headlight according to Embodiment 3 of the present invention.

The light source for headlight 100 shown in FIG. 28 is a light source for low-beam light in which the light emitting element 1 is enclosed in the light guide member 3, and the light emitting element 1 is arranged above the optical axis C1 of the projection lens part 33. In the light source for headlight 100 shown in FIG. 28, instead of forming a reflection surface part for light distribution formation in the light guide member 3, a reflecting member for light distribution formation 7 is enclosed in the light guide member 3. The reflecting member for light distribution formation 7 is made of, for example, a sheet metal, and forms the light distribution of low-beam light by reflecting a part of light emitted by the light emitting element 1, like the reflection surface part for light distribution formation.

In each of the light sources for headlight 100 explained in Embodiments 1 to 3, which is used for a low-beam light and in which the light emitting element 1 is arranged outside the light guide member 3, instead of forming a reflection surface part for light distribution formation in the light guide member 3, a reflecting member for light distribution formation may be enclosed in the light guide member 3, like in the case of the light source for headlight 100 shown in FIG. 28.

Further, the headlight in which the light source for headlight 100 according to Embodiment 3 is disposed is not limited to a vehicle-mounted headlight. The light source for headlight 100 can also be used for a headlight for any type of moving object including a vehicle, a rail car, a ship, or an airplane.

As described above, in the light source for headlight 100 according to Embodiment 3, the light emitting element 1 is enclosed in the light guide member 3. As a result, a positional displacement of the light emitting element 1 with respect to the light guide member 3 can be prevented in a state in which the light source for headlight 100 is assembled, so that the light source for headlight 100 can be easily handled.

Further, the light source for headlight 100 is a light source for low-beam light. The light guide member 3 has a reflection surface part for light distribution formation 34 disposed between the light emitting element 1 and the reflection surface part 32. An edge 35 of the reflection surface part for light distribution formation 34, the edge being on a side of the reflection surface part 32, is arranged at a combined focal point F1" of the projection lens part 33 and the reflection surface part 32. The optical axis C2 of the reflection surface part 32 is oriented toward a center of an angle θ1' which the optical axis C1 of the projection lens part 33 forms with a straight line L2 passing through the optical center O of the reflection surface part 32 and the central part of the light emitting surface 11 of the light emitting element 1. By disposing the reflection surface part for light distribution formation 34, a light source for low-beam light can be configured. Further, such a light source for low-beam light can also be used as a light source for vehicle-mounted cornering lamp, and a light source for vehicle-mounted fog lamp.

Further, the light source for headlight 100 is a light source for high-beam light. The central part of the light emitting surface 11 of the light emitting element 1 is arranged at a combined focal point F1" of the projection lens part 33 and the reflection surface part 32. The optical axis C2 of the reflection surface part 32 is oriented toward a center of an angle θ1' which the optical axis C1 of the projection lens part 33 forms with a straight line L2 passing through the optical center O of the reflection surface part 32 and the central part of the light emitting surface 11 of the light emitting element 1. By arranging the central part of the light emitting surface 11 at the combined focal point F1", a light source for high-beam light can be configured. Further, such a light source for high-beam light can also be used as a light source for vehicle-mounted DRL.

Further, the light source for headlight 100 is a light source for specific direction illumination light. The central part of the light emitting surface 11 of the light emitting element 1 is arranged apart from the optical axis C1 of the projection lens part 33 at a longer distance than a combined focal point F1" of the projection lens part 33 and the reflection surface part 32. The optical axis C2 of the reflection surface part 32 is oriented toward a center of an angle θ1' which the optical axis C1 of the projection lens part 33 forms with a straight line L2 passing through the optical center O of the reflection surface part 32 and the central part of the light emitting surface 11 of the light emitting element 1. By arranging the central part of the light emitting surface 11 apart from the optical axis C1 at a longer distance than the combined focal point F1", a light source for specific direction illumination light can be configured. Further, such a light source for specific direction illumination light can also be used as a light source for sign pole illumination.

Embodiment 4

Figure 29:
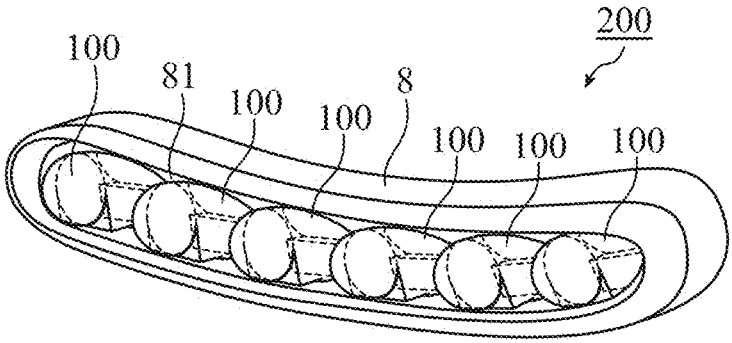
FIG. 29 is a perspective view of a headlight according to Embodiment 4 of the present invention.

A vehicle-mounted headlight 200 in which light sources for headlight 100 each according to any of Embodiments 1 to 3 are disposed will be explained with reference to FIG. 29.

In the figure, the numeral 8 denotes a case. The case 8 has a front opening, and a front lens 81 is disposed in this front opening. In the case 8, a plurality of light sources for headlight 100 is arranged, and a projection lens part 33 of each of the light sources for headlight 100 is oriented toward the front lens 81. The headlight 200 is configured in this way.

The headlight 200 can implement various light distributions by freely selecting, as each of the plurality of light sources for headlight 100, a light source for headlight from among the light sources for headlight 100 illustrated in Embodiments 1 to 3, and their modifications. Hereafter, examples of a light distribution implemented by the headlight 200 will be explained with reference to FIGS. 30 to 33.

Figure 30:
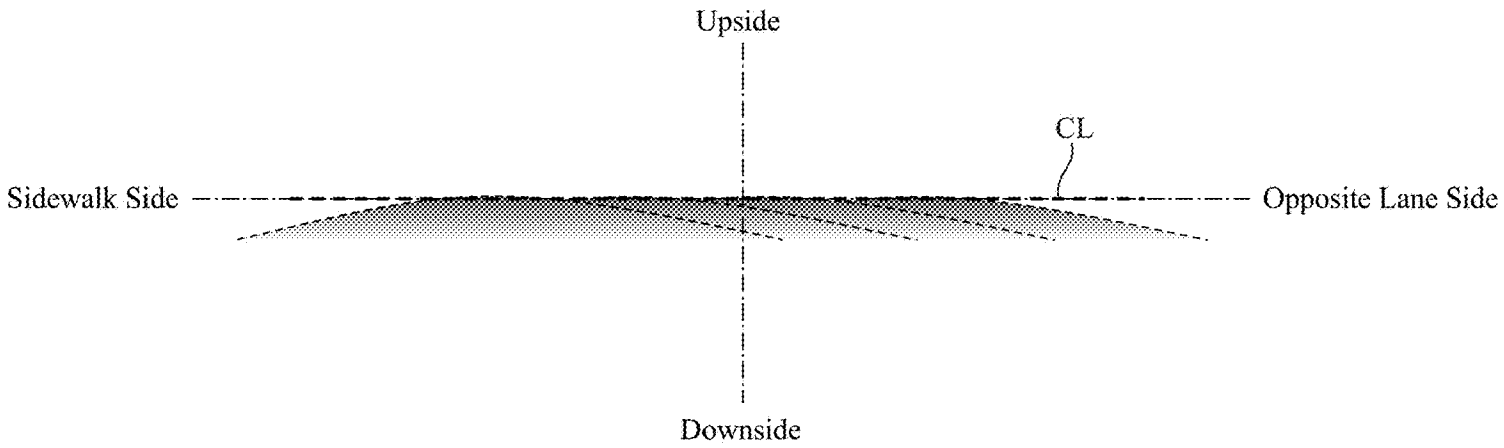
FIG. 30 is an explanatory drawing showing an example of a light distribution implemented by the headlight shown in FIG. 29.

For example, in the headlight 200, the light source for headlight 100 shown in FIG. 9 is used for all of the light sources for headlight 100. As a result, a light distribution of a low-beam light in which the cutoff line CL is leveled can be formed as shown in FIG. 30. Further, because the light distribution of each of the light sources for headlight 100 is curved in such a way that both ends thereof are positioned to be lower than the center thereof, even when there is a positional displacement in the vertical direction between the light beams emitted by adjacent light sources for headlight 100, the positional displacement can be made inconspicuous.

Figure 31:
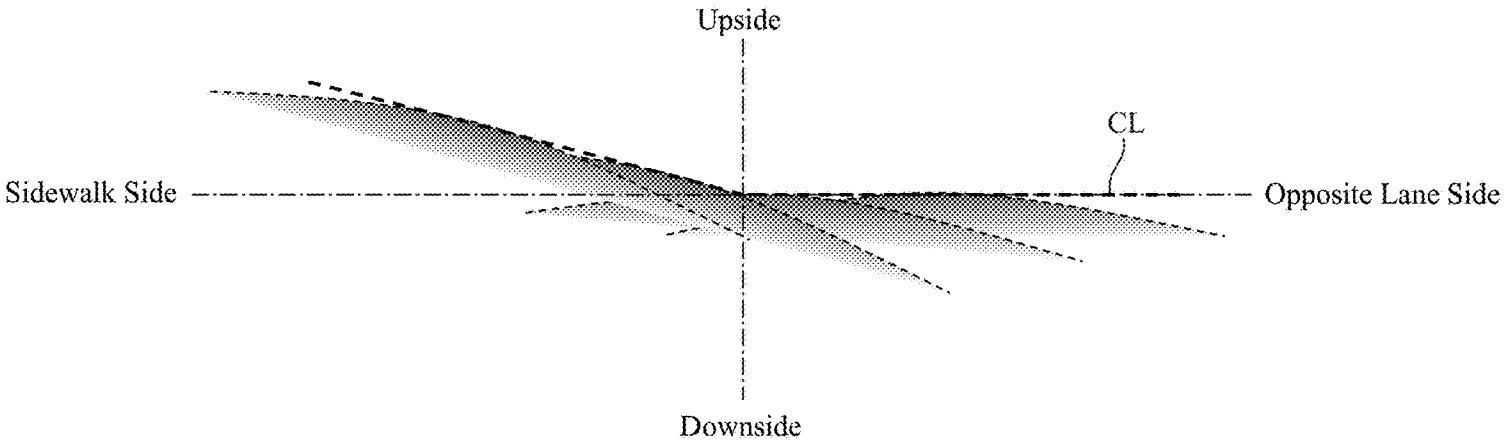
FIG. 31 is an explanatory drawing showing another example of the light distribution implemented by the headlight shown in FIG. 29.

As an alternative, in the headlight 200 which forms a light distribution shown in FIG. 30, the optical axes C1 of light sources for headlight 100 which correspond to a light distribution on the sidewalk side, among the plurality of light sources for headlight 100, are oriented upward in such a way that their upward angles gradually increase with the distance from the center of the cutoff line CL to an end of the cutoff line CL, and the edge 35 of the reflection surface part for light distribution formation 34 is inclined gradually with respect to the optical axis C1 with the distance from the center of the cutoff line CL to the end of the cutoff line CL. As a result, a light distribution in which an illumination area on the sidewalk side is enlarged in the upward direction can be formed as shown in FIG. 31. As a result, a low-beam light which makes it easy for the driver of the user's vehicle to visually recognize the sidewalk can be implemented while preventing the drivers of oncoming vehicles from being dazzled.

Figure 32:
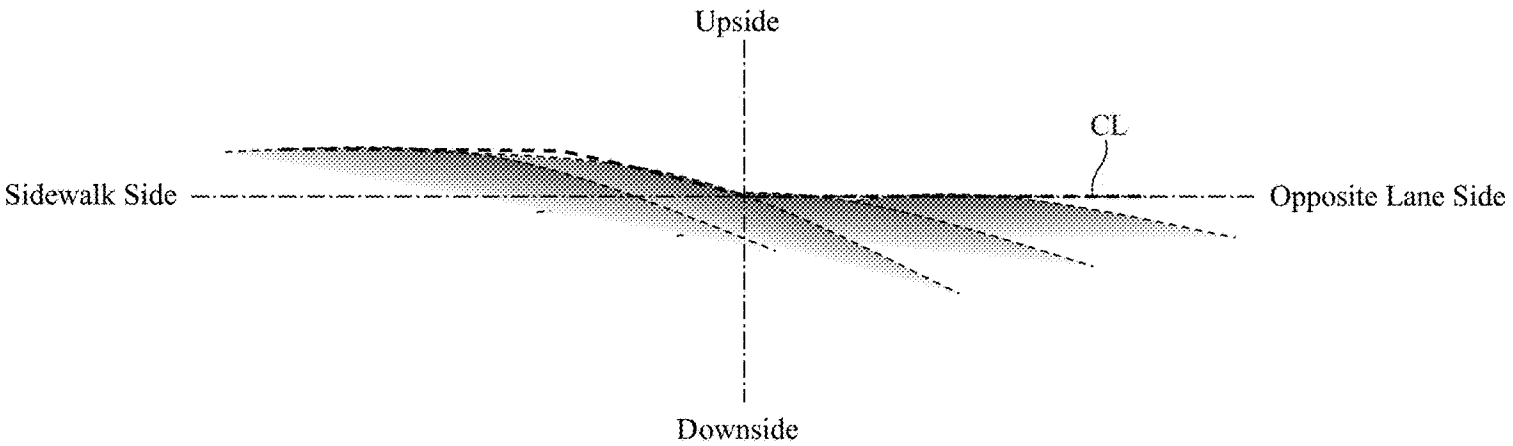
FIG. 32 is an explanatory drawing showing another example of the light distribution implemented by the headlight shown in FIG. 29.

As an alternative, in the headlight 200 which forms a light distribution shown in FIG. 31, the edge 35 of the reflection surface part for light distribution formation 34 is formed to be horizontal in each of the light sources for headlight 100 corresponding to the light distribution on the sidewalk side. As a result, a light distribution in which the cutoff line CL is formed into a stepwise shape can be formed as shown in FIG. 32.

Figure 33:
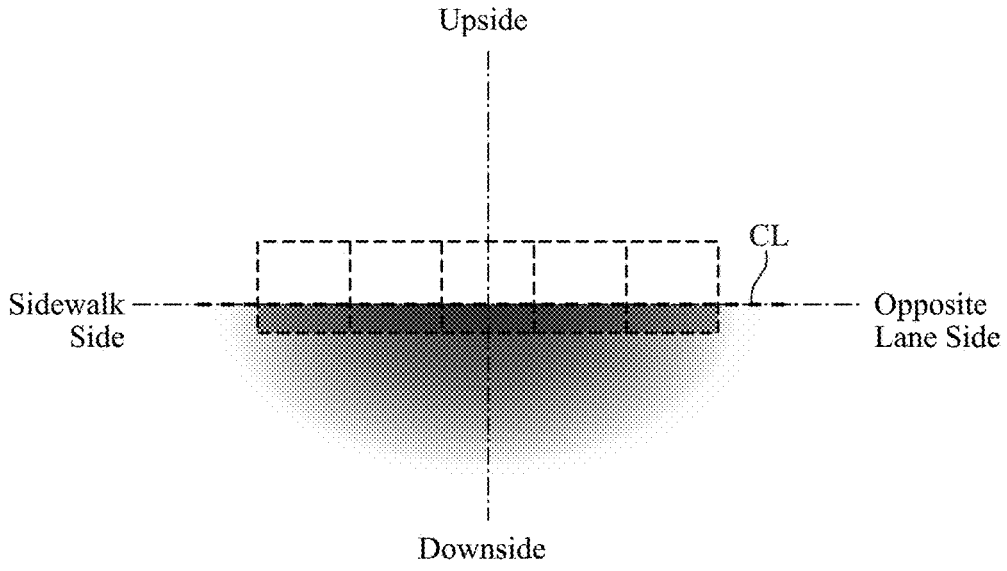
FIG. 33 is an explanatory drawing showing another example of the light distribution implemented by the headlight shown in FIG. 29.

As an alternative, in the headlight 200, a combination of a light source for headlight 100 which is used for a low-beam light, and a plurality of light sources for headlight 100 which are used for a specific direction illumination light is used. For example, it is assumed that each of the light sources for headlight 100 which are used for the specific direction illumination light illuminates an area including an area above the cutoff line CL, and illuminates an area different and adjacent to each other, as shown in FIG. 33. By individually switching on or off each of the light sources for headlight 100 which are used for the specific direction illumination light dependently on the presence or absence of an oncoming vehicle or a pedestrian or the like, the light distribution above the cutoff line CL can be finely controlled.

As described above, since the number of light sources for headlight 100 and the light distribution of each of the light sources for headlight 100 can be freely selected, the degree of flexibility in the design of the internal structure, the external shape, the light distribution formation, and so on of the headlight 200 can be increased. As a result, a headlight 200 suitable for the use, the requirement specifications, and so on can be easily configured.

As described above, the headlight 200 according to Embodiment 4 includes light sources for headlight 100. By freely combining a plurality of light sources for headlight 100 each of which is a light for a low-beam light, a high-beam light, or a specific direction illumination light, the degree of flexibility in the design of the headlight 200 can be increased.

It is to be understood that any combination of two or more of the above-mentioned embodiments can be made, various modifications can be made in any component according to any one of the embodiments, and any component according to any one of the embodiments can be omitted within the scope of the invention.

INDUSTRIAL APPLICABILITY

The light source for headlight according to the present invention can be used for a headlight for a moving object such as a vehicle, a rail car, a ship, or an airplane. In particular, the light source for headlight is suitable for a vehicle-mounted headlight.

REFERENCE SIGNS LIST

1 light emitting element, 2 fixing member, 3 light guide member, 4 screw, 5 refracting member, 6 incidence member, 7 reflecting member for light distribution formation, 8 case, 11 light-emitting surface, 12 edge, 13 edge, 31 incidence surface part, 32 reflection surface part, 33 projection lens part, 34 reflection surface part for light distribution formation, 35 edge, 36 fixing part, 37, 37*a* refracting part, 38, 38*a* incidence part, 81 front lens, 100 light source for headlight, and 200 headlight.

The invention claimed is:

1. A light source for headlight comprising:

a light emitting element; and a light guide member having a reflection surface part reflecting light emitted by the light emitting element, and a projection lens part projecting the light reflected by the reflection surface part onto an area ahead of a moving object, wherein the light emitting element is arranged to be displaced from an optical axis of the projection lens part, and the reflection surface part is in a shape of a concave mirror having an optical axis and one focal point on the optical axis, an optical center which is an intersection of the reflection surface part and the optical axis of the reflection surface part is arranged on the optical axis of the projection lens part and between the projection lens part and a focal point of the projection lens part, and the optical axis of the reflection surface part is oriented in a direction passing a position between a central part of a light emitting surface of the light emitting element and a central part of the projection lens part.

2. The light source for headlight according to claim 1, wherein the light source for headlight is a light source for low-beam light, a light source for high-beam light, or a light source for specific direction illumination light.

3. The light source for headlight according to claim 2, wherein the light source for headlight is the light source for low-beam light, and wherein the light guide member has a reflection surface part for light distribution formation disposed between the light emitting element and the reflection surface part, an edge of the reflection surface part for light distribution formation, the edge being on a side of the reflection surface part, is arranged at a combined focal point of the projection lens part and the reflection surface part, and the optical axis of the reflection surface part is oriented toward a center of an angle which the optical axis of the projection lens part forms with either a straight line passing through the optical center of the reflection surface part and a central part of the edge of the reflection surface part for light distribution formation, the edge being on aside of the reflection surface part, or a straight line passing through the optical center of the reflection surface part and the central part of the light emitting surface of the light emitting element.

4. The light source for headlight according to claim 2, wherein the light source for headlight is the light source for high-beam light, and the central part of the light emitting surface of the light emitting element is arranged at a combined focal point of the projection lens part and the reflection surface part, and the optical axis of the reflection surface part is oriented toward a center of an angle which the optical axis of the projection lens part forms with a straight line passing through the optical center of the reflection surface part and the central part of the light emitting surface of the light emitting element.

5. The light source for headlight according to claim 2, wherein the light source for headlight is the light source for specific direction illumination light, and the central part of the light emitting surface of the light emitting element is arranged apart from the optical axis of the projection lens part at a longer distance than a combined focal point of the projection lens part and the reflection surface part, and the optical axis of the reflection surface part is oriented toward a center of an angle which the optical axis of the projection lens part forms with a straight line passing through the optical center of the reflection surface part and the central part of the light emitting surface of the light emitting element.

6. The light source for headlight according to claim 3, wherein the light emitting element is arranged above the optical axis of the projection lens part, and an edge of the light emitting surface of the light emitting element, the edge being on a front side of the moving object, is arranged either on a surface extending along the reflection surface part for light distribution formation, or closer to a rear side of the moving object with respect to the surface extending along the reflection surface part for light distribution formation.

7. The light source for headlight according to claim 3, wherein the light emitting element is arranged below the optical axis of the projection lens part, and an edge of the light emitting surface of the light emitting element, the edge being on a rear side of the moving object, is arranged either on a surface extending along the reflection surface part for light distribution formation, or closer to a front side of the moving object with respect to the surface extending along the reflection surface part for light distribution formation.

8. The light source for headlight according to claim 3, wherein a normal of the light emitting surface of the light emitting element at a central part of the light emitting surface is oriented toward the central part of the edge of the reflection surface part for light distribution formation, the edge being on the side of the reflection surface part.

9. The light source for headlight according to claim 3, wherein the edge of the reflection surface part for light distribution formation, the edge being on the side of the reflection surface part, is formed into a curved shape in such a way that both ends thereof are closer to the optical axis of the projection lens part than a center thereof.

10. The light source for headlight according to claim 3, wherein the edge of the reflection surface part for light distribution formation, the edge being on the side of the reflection surface part, is shaped in such a way that at least a part thereof is inclined in a front-rear direction of the moving object.

11. The light source for headlight according to claim 3, wherein the edge of the reflection surface part for light distribution formation, the edge being on the side of the reflection surface part, is formed into a curved shape in such a way that a center thereof protrudes toward a rear or front side of the moving object in comparison with both ends thereof.

12. The light source for headlight according to claim 1, wherein the reflection surface part is configured so as to receive incident light emitted by the light emitting element incident to the reflection surface part at an angle equal to or larger than a critical angle and reflect the incident light at an internal surface portion of the light guide member, or so as to reflect incident light emitted by the light emitting element with a plating or a coating formed on an external surface portion of the light guide member.

13. The light source for headlight according to claim 1, wherein the light emitting element is arranged outside the light guide member, and the light source for headlight further comprises an incidence member guiding light emitted by the light emitting element into the light guide member.

14. The light source for headlight according to claim 1, wherein the light emitting element is enclosed in the light guide member.

15. A headlight for a moving object comprising the light source for headlight according to claim 1.

* * * * *